United States Patent [19]

Dickinson, III et al.

[11] 4,431,069

[45] Feb. 14, 1984

[54] METHOD AND APPARATUS FOR FORMING AND USING A BORE HOLE

[76] Inventors: Ben W. O. Dickinson, III, 2125 Broderick St., San Francisco, Calif. 94115; Robert W. Dickinson, 40 Maplewood Dr., San Rafael, Calif. 94901

[21] Appl. No.: 169,759

[22] Filed: Jul. 17, 1980

[51] Int. Cl.[3] ..... E21B 7/06; E21B 7/18

[52] U.S. Cl. ..... 175/61; 175/320; 175/67; 166/278

[58] Field of Search ..... 405/45, 50; 175/65, 175/104, 67, 61, 171, 320; 138/103, 110; 166/319, 278; 299/5

[56] References Cited

U.S. PATENT DOCUMENTS

| | | | |
|---|---|---|---|
| 2,271,005 | 1/1942 | Grebe | 175/61 |
| 2,513,944 | 7/1950 | Kessler | 166/278 |
| 2,729,294 | 1/1956 | Adams | 166/231 |
| 3,105,046 | 9/1963 | Fischer | 252/8.5 C |
| 3,640,344 | 2/1972 | Brandon | 175/61 |
| 3,873,156 | 3/1975 | Jacoby | 175/61 |
| 3,899,431 | 8/1975 | Hayes | 252/8.5 P |
| 4,012,329 | 3/1977 | Hayes | 175/65 |

*Primary Examiner*—William F. Pate, III

*Attorney, Agent, or Firm*—Flehr, Hohbach, Test, Albritton & Herbert

[57] ABSTRACT

A system for the formation and use of a bore hole, particularly for the recovery of oil from an oil-bearing underground formation. An eversible elongate permeable tube, preferably formed of woven cloth, including other and inner walls, connected at a rollover area, is urged into the formation by a driving fluid. Drilling fluid is pumped through a central passageway in the tube and carries a central pipe forward. The drilling fluid, comprising a hot acid or basic aqueous or petroleum base solution, assists break up of the formation to form a cuttings slurry which passes back along the outside of the eversible tube. Means is provided for turning the tube, as from the vertical to the horizontal, by use of a turning segment in the eversible tube, or by guiding the central pipe. Such pipe preferably includes a flexible helical segment capable of turning and of serving as the ultimate support casing. Also, gravel packing techniques and down-hole steam generators.

42 Claims, 44 Drawing Figures

METHOD AND APPARATUS FOR FORMING AND USING A BORE HOLE

BACKGROUND OF THE INVENTION

A conventional drill hole for producing oil from an oil-bearing formation is formed by drilling with a rotary bit driven by a rotating drill pipe which extends through the central opening of a well. A drilling fluid is passed centrally through the drill pipe to remove the cuttings in the excavated area ahead of the bit, in the form of a slurry which is pumped to the surface in the annular space left between the drill pipe and adjacent earth formation. A casing is sunk into the bore hole after drilling.

To drill to great depths, the well may be drilled in steps of successively smaller diameters. At the end of each step, the rotary drill pipe and bit are removed from the hole and a well casing is installed. The original bit is then replaced with a smaller diameter bit to allow it to fit inside the well casing. This use of smaller and smaller bits along with attendant subsequently installed casings results in the formation of a bore hole at the desired depth.

There are a number of disadvantages to the foregoing technique. Firstly, it is inefficient and expensive to continuously operate a rotary drill system and bit at extended depths. Secondly, the casing, typically formed of steel, is expensive and is difficult to install. Thirdly, it is difficult to change the direction of the drilling in the earth formation at radii of less than about 1,000–2,000 feet as would be desirable for efficient production of petroleum. Fourthly, the rotation of the drill pipe to which the bit is attached within the casing creates great friction, power loss and wear of both drill pipe and casing.

Also, there is no simple method to make the transition from a drilled vertical bore hole to a horizontal bore hole and to drill along an oil-bearing formation essentially horizontally to permit injection of steam, solvents or other fluids into the formation for enhanced oil recovery from the formation. This capability is particularly required for heavy (high viscosity) oil-bearing formations.

A number of techniques have been attempted to form lateral (essentially horizontal) bore holes from a vertical cased bore hole. In one technique, an oversized vertical bore hole is formed of sufficiently large diameter such that miners may descend to a location near the bottom of the hole from which they can drill horizontal holes by conventional means. This technique is both costly and dangerous, particularly at great depths.

Another technique which has been attempted is known as drainhole drilling. Here, a vertical bore hole is drilled with rotary equipment in a conventional way to form a drill column. A special assembly is attached to the lower end of the drill column, including a preformed, non-rotating, curved guide tube and an inner, flexibly jointed, rotatable drive pipe. Then, the drill passes along the curved assembly in a generally lateral direction to drill a substantially horizontal bore hole. A system of this type is described in an article entitled "Drain Space Holes for Tired Old Wells", by D. H. Stormont, *Oil and Gas Journal,* 53, page 144, Oct. 11, 1954. This system is subject to the disadvantage that there is a high frictional relationship between the curved, flexibly jointed drill pipe and the formation, and it is difficult to form truly horizontal bore holes; instead, downwardly directed bore holes with relatively large turning radii are formed, which are not as desirable as horizontal bore holes. In addition, such bore holes are costly to drill. Also, the cuttings are difficult to remove. Another disadvantage is that the deflected rotating drill pipe tends to wear out due to continuous frictional contact with the formation. Finally, the friction between the deflected rotating drill pipe and the formation limits the extent of the drill penetration.

Another technique has been suggested for driving and lining an underground conduit, primarily in a horizontal direction. There is no suggestion that this system could be employed for drilling oil from an oil-bearing formation or that it could be used to excavate vertically for that purpose. Such system is described in Silverman U.S. Pat. No. 3,422,631. It includes an eversible tube which is driven forwardly under fluid pressure against a bullet-shaped object which is, in turn, moved forwardly through the earth to form a conduit. In this system, there is no suggestion of passing a drilling fluid to, or to form a slurry at, the forward end of the bullet-shaped object to facilitate drilling; in fact, the system is incapale of doing so as it does not provide a channel within the eversible tube for such a fluid. Thus, the soil at the forward end of the bullet-shaped object is compressed by creating great frictional forces which prevent the system from being moved to any considerable distance.

Another system showing a movable eversible tube is disclosed in Masuda U.S. Pat. No. 4,077,610. In this patent, the eversible tube is passed through a preexisting hollow pipe for purposes of passing an article through the pipe. However, nothing in this patent suggests drilling an underground formation in advance of the eversible tube, or of passing a drilling fluid through the eversible tube.

SUMMARY OF THE INVENTION AND OBJECTS

The present invention is directed to the formation and use of a bore hole, for the recovery of oil from an oil-bearing formation, the recovery of mineral deposits or the like. An important feature of the invention is the use of an eversible, elongate, tube of flexible material with outer and inner walls connected by a rollover area at one end of the tube. The rollover area is urged forwardly by driving fluid directed into an annulus formed between the walls. The eversible tube may be formed from a permeable material to provide controlled leakage of the driving fluid through the walls of the tube along its entire length.

A central passageway is defined by the inner wall of the eversible tube. A central pipe is in this passageway. Drilling fluid flows through that passageway around the central pipe disposed therein to cause the central pipe to be separated from the inner wall by a fluid layer and thus be relatively independent of the forward movement of the inner wall of the eversible tube. Also, drilling fluid is pumped through the central pipe whose forward, open end is near the rollover area of the eversible tube. The drilling fluid issuing from the forward end of the central pipe drills the formation and forms a slurry with the cuttings from the formation. This slurry may be removed from the drilling zone by being moved along the outer wall of the eversible tube in a direction opposite to the forward direction of movement of the rollover area. It is also likely that the formation mineral solids will rearrange to effect a change in the porosity and specific volume of the formation in the vicinity of the drill.

For the recovery of oil, the drilling fluid used with the present invention preferably comprises an acidic or basic aqueous solution, which may include entrained air, which fluid serves to form an emulsion from the oil in the formation which assists in breaking the in situ structure or matrix of the formation into a slurry with the assistance of hydraulic fluidization by the drilling fluid. The drilling process creates a flow tube or bore hole larger than the diameter of the eversible tube. This allows the slurry to pass from the drilling zone rearwardly exterior to the outer wall of the eversible tube and to the ground level or other location.

An important aspect of the invention is the ability to guide the eversible tube in a desired direction through an underground formation, specifically from a vertical direction to a horizontal direction. This may be accomplished by the use of a turning segment on the eversible tube or by guiding the central pipe by using any of a variety of techniques. Preferably, the central pipe includes a flexible, helical segment formed from a strong material, such as steel, and being capable of flexing or bending and also of forming a strong casing support capable of withstanding external formation pressures. In that regard, the central pipe preferably is fed continuously through the eversible tube from the surface and forms a strong well casing along the entire length of the bore hole formed by the drilling fluid passing through the central pipe. When the eversible tube is formed from a liquid permeable fabric and surrounds a self-supporting, liquid permeable central pipe, such as a steel helix, a cased bore hole can be formed in which the bore hole is surrounded by a bag filter, i.e., the eversible tube, which is comparable to a conventional bore hole casing having surrounding gravel packing. In another aspect of the invention, gravel packing may be passed into the annular space between the outer and inner walls of the eversible tube after a bore hole has been formed. If the eversible tube is formed of liquid permeable fabric, it may remain in place with the gravel packing therein. Alternatively, it may be disintegrated such as by an acid, if desired, leaving only the gravel packing surrounding the central pipe.

Another aspect of the invention includes a down-hole steam generator for providing hot drilling fluid in close proximity to the drilling zone or area of slurry formation. In one embodiment of the invention, an axially aligned fan-like vane means is provided on the central pipe near the drilling zone to separate air and an air-aqueous liquid mixture into an outer annulus of aqueous liquid and a central core of air, which is utilized for in situ combustion. In another embodiment of the invention, the liquid passes through an annular space around the central cavity in which air is passed for combustion.

It is an object of the invention to provide a system for forming a bore hole which is substantially less expensive than the systems of the prior art.

It is a particular object of the invention to provide a sysem of the foregoing type capable of drilling a vertical hole to substantial depths and of pre-programming a turn, specifically a right angle turn from the vertical to the horizontal, in the drill hole.

It is another object of the invention to provide a system of the foregoing type capable of drilling into unconsolidated formations without the necessity of using a rotating drill pipe driven from the surface.

It is a particular object of the invention to provide a system for forming a bore hole, which system is capable of remote, directional control of a drilling means moving vertically or horizontally through earth formations.

It is another object of the invention to provide a system of the type described which is capable of carrying equipment, such as logging equipment, down a bore hole.

It is a further object of the invention to provide a system of the foregoing type which is capable of placing an inexpensive external casing and permanent internal core casing along a bore hole concurrently with the formation of the bore hole.

It is a specific object of the invention to provide an inexpensive system for forming a filter for liquids in an underground formation which permits the passage of production liquids through the walls of the bore hole and then to the earth's surface.

Further objects and features of the invention will be apparent from the following description taken in conjunction with the appendant drawings.

DETAILED DESCRIPTION OF THE PREFERRED EMBODIMENTS

An important embodiment of the present invention comprises an eversible, elongate, flexible tube in the form of a rolling diaphragm which serves as a barrier to separate drilling fluid being carried forwardly into a bore hole in an underground oil- or mineral-bearing formation from slurry cuttings travelling rearwardly towards the surface of the ground to evacuate the underground area. The eversible tube includes a forward rollover area and a central passageway therethrough for receiving a central pipe which is adapted to carry pressurized drilling fluid from a fluid source to the forward, open end of the central pipe near the rollover area of the central tube. The eversible tube is directed into the underground formation and the drilling fluid creates a slurry with the formation cuttings at the rollover area, which slurry is directed along to the outside of the eversible tube and rearwardly of the rollover area to create a channel for passage of slurry to the surface of the formation. The rollover area is moved forwardly by a pressurized driving fluid pumped into the space between the inner and outer walls of the eversible tube, with the outer wall being retained in a fixed position relative to forward movement of the rollover area through the bore hole. As explained more fully below, this substantially eliminates friction between the outer wall of the eversible tube and the surrounding formation.

Figure 1:
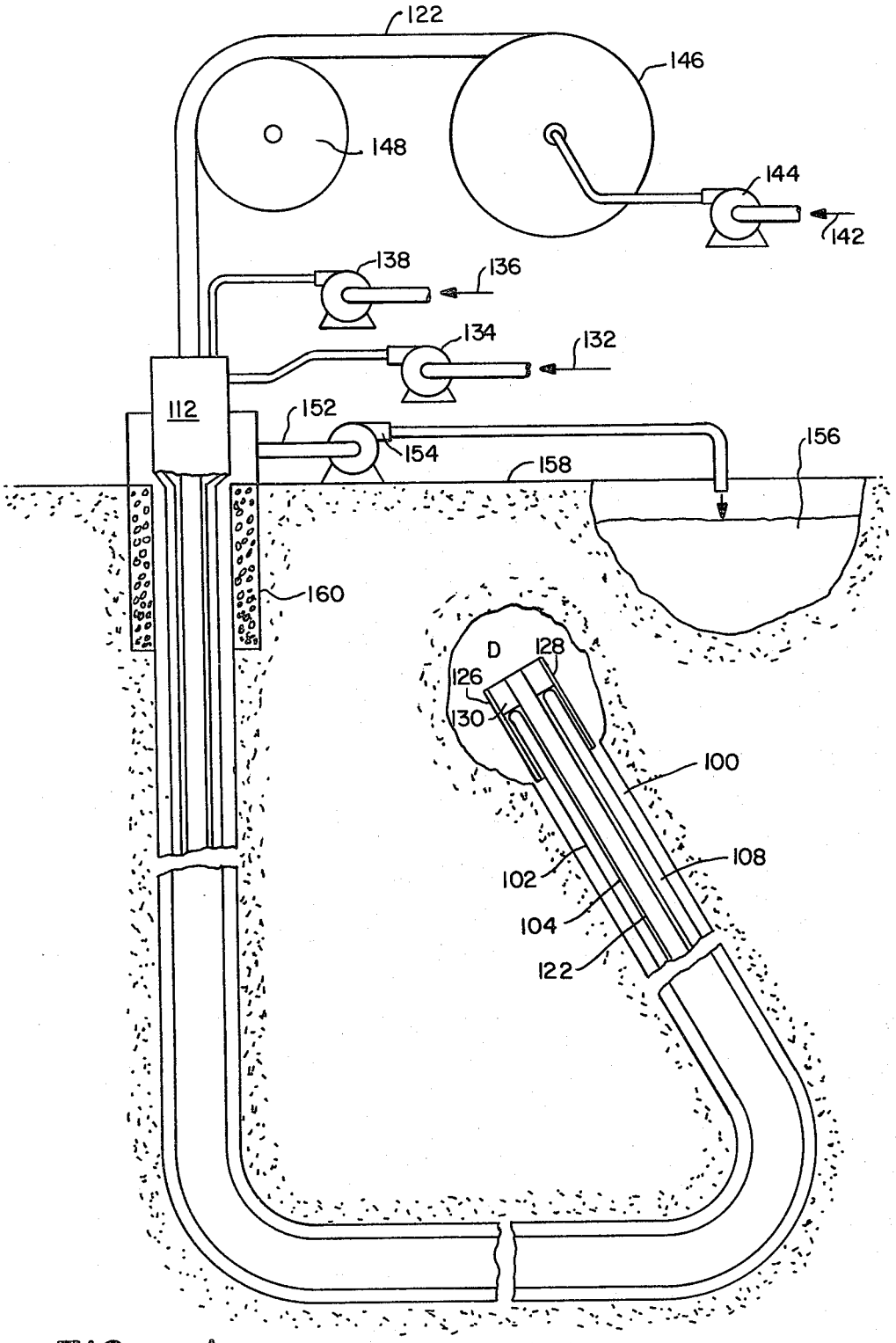
FIG. 1 is a side elevational view, partially in section, illustrating the system of the present invention and showing two pre-programmed turns of the eversible tube and central pipe of the system.
Figure 5:
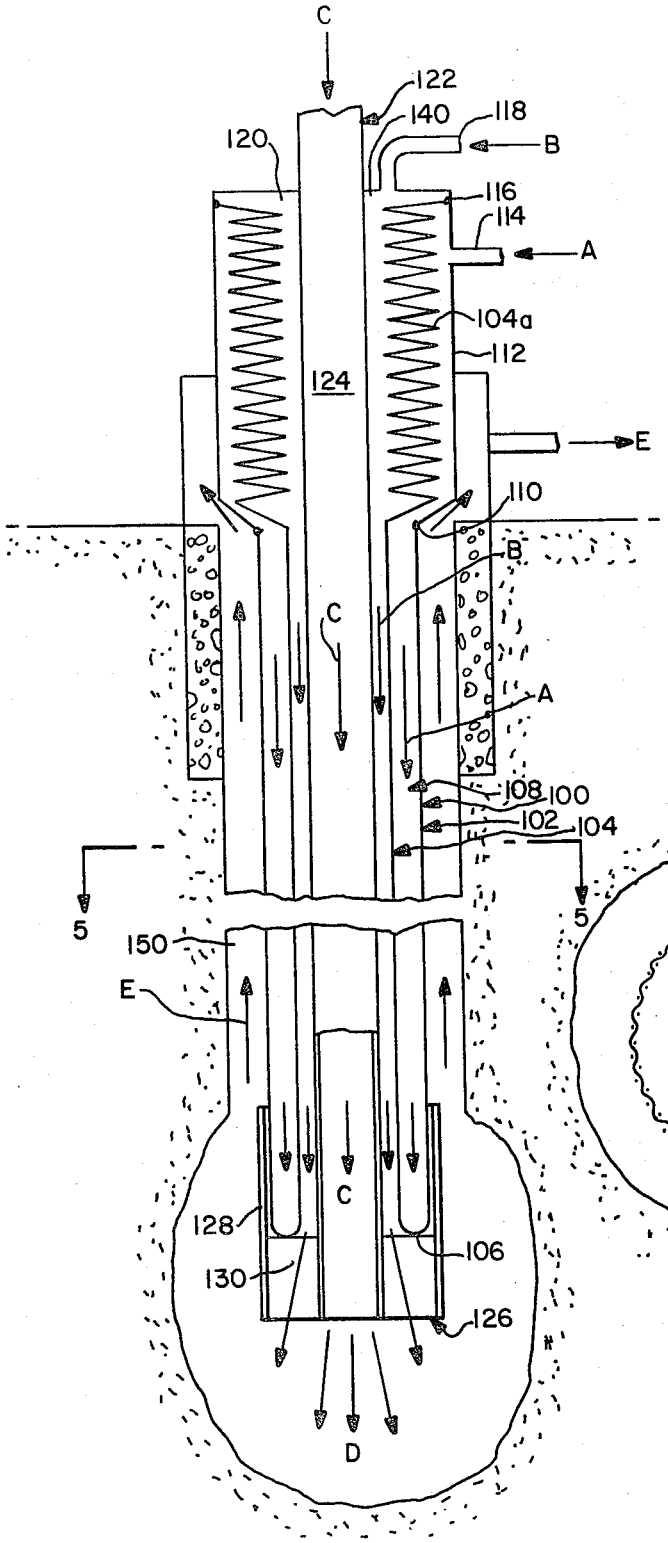
FIG. 5 is an enlarged, fragmentary cross-sectional view, partially schematic, of the top and bottom portions of the system of FIG. 1.
Figure 6:
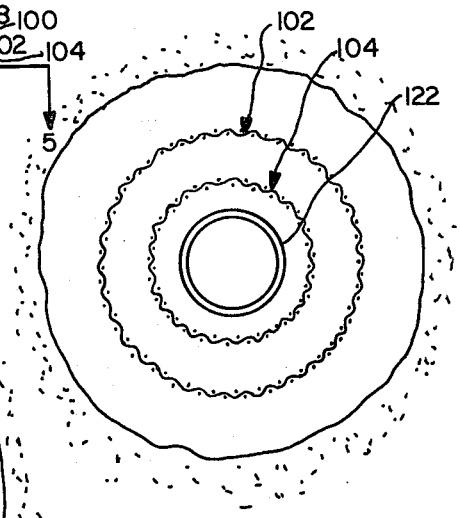
FIG. 6 is a cross-sectional view taken along line 5—5 of FIG. 5.

Referring to FIGS. 1, 5 and 6, the principles of operation of the present system are illustrated. Referring specifically to FIG. 5, the drilling unit of this invention includes an eversible, elongate tube, generally designated by the number 100, which serves the function of a rolling diaphragm which moves forwardly in a manner to be described below. Tube 100 includes flexible, generally cylindrical outer and inner tubular walls 102 and 104, respectively, interconnected at their forward ends by rollover area 106, capable of being moved forwardly. The tube is preferably formed of a high-strength permeable woven material or cloth. The outer and inner walls have an opening near their rearward ends and define an annular space 108 therebetween which serves as a passageway for driving fluid from a source to be described below.

Means is provided in the form of an annular retaining ring 110 for securing the rearward end of the outer wall to a stationary support (not shown) in a fixed position relative to movement of rollover area 106. Downstream of retaining ring 110, inner wall 104 forms a tube which is carried forwardly by driving fluid in annulus 108. In a preferred embodiment, tube 100 is relatively non-expandable and so, to permit inner wall 104 to form outer wall 102 of larger diameter, wall 104 includes sufficient slack material to accommodate this transformation, to provide a relatively long outer wall, such as one having a final length of 200–300 feet or more.

Upstream or rearwardly from retaining ring 110, a long length **104*a* of flexible inner wall 104 may be collected in a relatively small space as by nesting in a pleated or accordion folded configuration, in an enlarged hollow tubular housing 112. A driving fluid inlet 114 is provided in the space between nested wall 104*a* and the outer wall of housing 112. The rearward end of inner wall 104*a* is suitably sealed to the inner wall of housing 112 at ring 116 upstream of inlet 114. By nesting wall 104*a* in the illustrated manner, it readily feeds through the annulus of retaining ring 110 without creating undue resistance to the forward movement of rollover area 106. To prevent a portion of nested inner wall 104*a* from uncontrollably falling through retaining ring 110 under the influence of gravity, a suitable retaining device, not shown, may be inserted in housing 112. Alternatively, the driving fluid directed to port 114 may be pressurized to a higher pressure than a pressurized fluid directed to an inlet 118 communicating with the interior of wall 104***a* to press wall 104*a* inwardly against a central pipe 122 extending through tube 100 and to be described below.

A central passageway 120 is defined to the interior of inner wall 104. Central pipe 122 extends in passageway 120 through tube 100 to at least the forward end of the central passageway adjacent to rollover area 106. Pipe 122 serves a number of functions, including as an internal support or as an ultimate strong casing for the bore hole to be drilled with the present invention, and as a means for directing the drilling apparatus as described below. In a preferred embodiment, it is adapted to be carried forwardly by frictional contact with the adjacent surface of inner wall 104 and by driving fluid entering inlet 118. As illustrated, central pipe 122 is hollow and defines an internal channel 124 for directing drilling fluid from a second source out the forward end of the central pipe and against the earth formation to be drilled.

Figure 10:
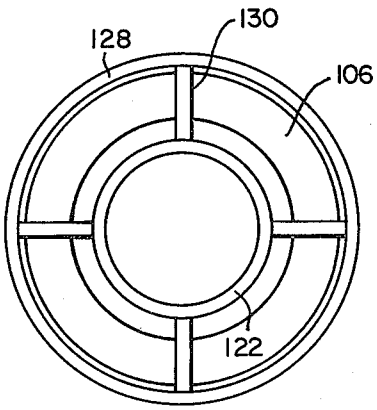
FIG. 10 is a cross-sectional view taken along line 10—10 of FIG. 9.
Figure 9:
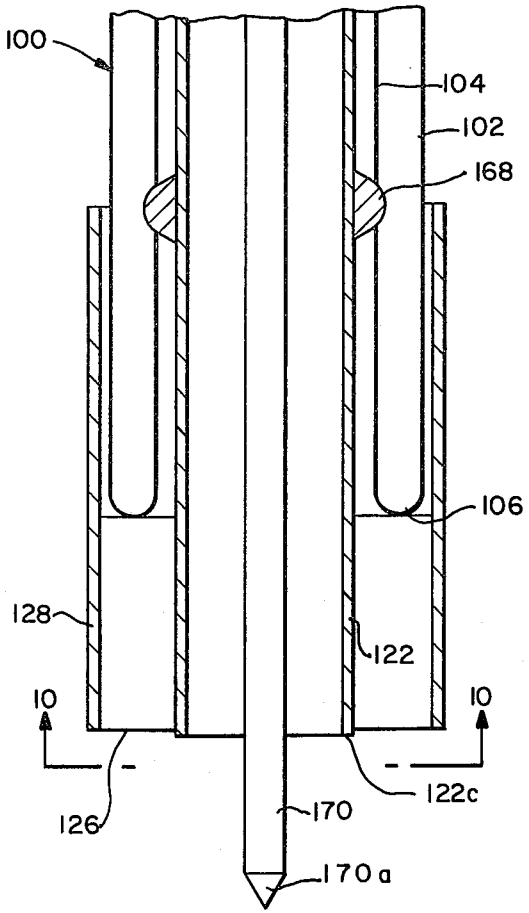
FIG. 9 is an enlarged, fragmentary cross-sectional view of the forward end of one embodiment of the present invention, illustrating a stabilizing structure on the central pipe including a centering rod and a stabilizing shroud.

Referring again to FIG. 5, a forward directional stabilizer 126 is provided in the form of an outer tubular shroud 128 and spaced radial fins 130, mounted to the forward end of central pipe 122. Shroud 128 is of slightly larger diameter than outer wall 102 and extends axially and concentrically along the wall, a distance preferably 1–4 times the diameter of tube 102. As rollover area 106 moves forward, it bears against the rearward surfaces of fins 130 and of shroud 128 to move the shroud forward. Fins 130 are preferably of radially disposed spoke-like configuration, each spoke extending a distance along the axis of the shroud (as illustrated in FIGS. 9 and 10) and extend an axial distance about 0.25–1 times the diameter of wall 102 for stability.

Referring to FIG. 6, in a preferred embodiment, outer and inner walls 102 and 104 and central pipe 122 are circular in cross section in concentric relationship with each other defining spaces therebetween.

Referring again to FIGS. 1 and 5, a driving fluid is directed from a source 132 to a pump 134 into inlet 114 in the direction of arrows A. Simultaneously, drilling fluid from a source 136 is directed through pump 138 through annulus 140 of central passageway 120, defined to the exterior of pipe 122 and the interior of wall 104 while a second source of driving fluid 142 is directed through pump 144 to the center of a generally flexible central pipe 122 wound on a spool in reel housing 146. A roller 148 may be provided to turn flexible central pipe 122 from a horizontal to a vertical direction for downward movement through annular retaining ring 110 into the device.

Figure 8:
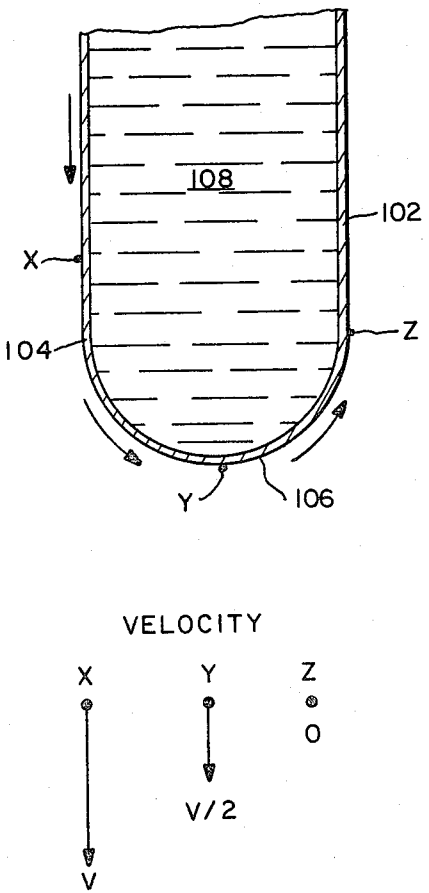
FIGS. 7 and 8 are enlarged cross-sectional views of portions of the forward end of the present invention illustrating the forward end of the rollover area of the eversible tube.

Referring specifically to FIG. 5, in operation, driving fluid A is pumped into the space 108 between walls 102 and 104 toward rollover area 106. Because outer wall 102 is fixed at ring 110, the inner wall moves downwardly and undergoes a transformation in shape to become the outer wall at the rollover area to create forward movement of the rollover area. Referring to FIG. 8, such movement is best illustrated by reference to points X, Y and Z. Thus point X (the side of wall 104) at a velocity V moves vertically downwardly to point Y (the apex of the rollover area) and point Y is moving vertically at one half the velocity of point X, and eventually to point Z (the side of wall 102), which is stationary. Since the exterior surface of outer wall 102 does not move relative to the surrounding formation at point Z and above there is no friction therebetween, an important factor in advancing central pipe 122 during drilling of the formation. Instead, all of the movement of central pipe 122 is with respect to the interior fluidized zone between inner wall 104 and central pipe 122, where friction is greatly reduced.

Referring again to FIGS. 1 and 5, drilling fluid from the surface is directed through annulus 140, in a direction generally designated by arrow B, and through channel 124 of pipe 122 as illustrated by arrow C, to create a fluidized slurry zone D created by mechanical, fluid mechanical and physical-chemical interactions of the drilling fluid with the surrounding formation. For drilling in an oil-bearing formation, it is preferable to use a drilling fluid which serves to fluidize the oil in a continuous oil or water phase, as described more fully below. In any event, the fluidized zone of slurry, designated "D" in FIGS. 1 and 5, is created forwardly of rollover area 106, and an outer annulus 150 between outer wall 102 and the surrounding formation is created during drilling and permits the movement of a slurry of cuttings in the direction of arrows E. When the slurry reaches the surface or other suitable location, it may be pumped through line 152 via pump 154 into a sump 156 at the surface 158 of the formation. Preferably, a suitable conventional support assembly and foundation 160 is provided in the ground to house and support the upstream end of the system. As illustrated in FIG. 1, an important feature of the present invention is the ability to turn eversible tube 100 in a predetermined direction, such as to bend it to a horizontal direction, and even to turn again, as toward the surface.

Another important feature of the invention is the lubrication inherently provided by the pressure of drilling fluid and/or driving fluid in the annulus space between inner tubular wall 104 and central pipe 122. The driving fluid may be supplied from source 118 and/or by weepage from the interior of central pipe 122 where such pipe is liquid permeable. The driving fluid is supplied by weepage through inner wall 104 where that wall is liquid permeable (e.g., by formation from a cloth fabric of the desired permeability). The resulting lubrication permits low friction sliding movement between inner wall 104 and central pipe 122 to permit inner wall 104 to move forward at a velocity twice that of central pipe 122.

Figure 2:
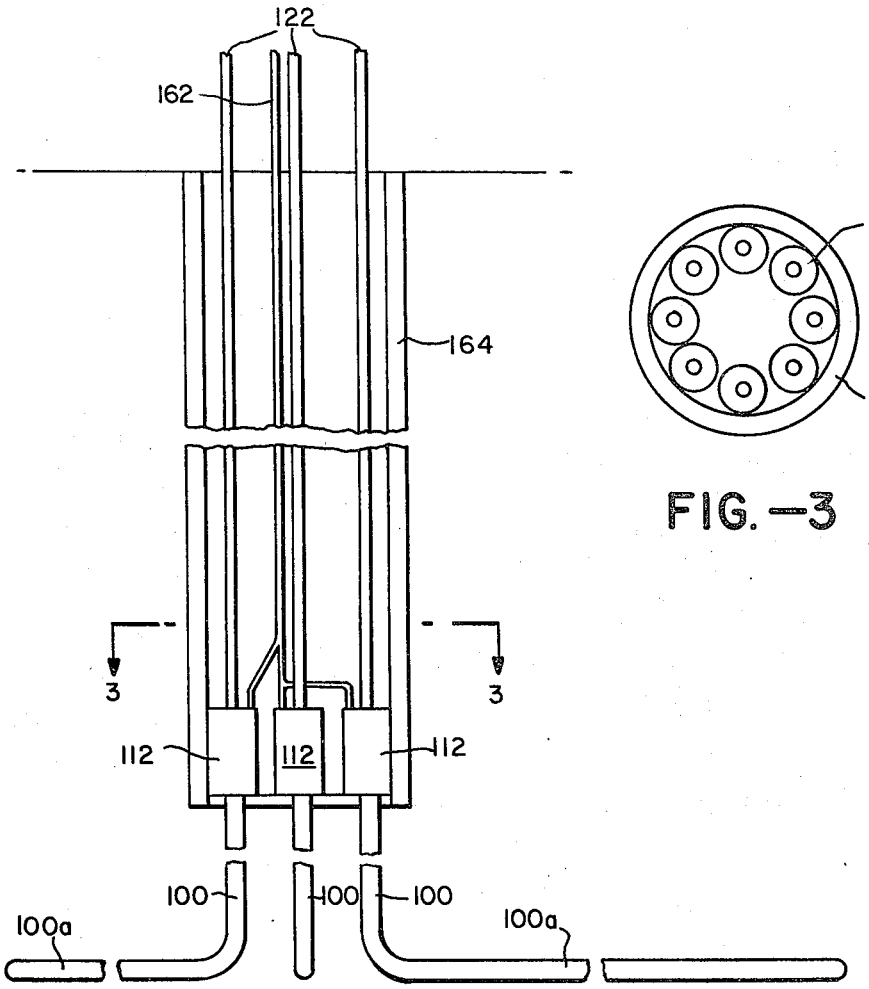
FIG. 2 is an enlarged, fragmentary side elevational view of a feed sytem for three independent drilling units of the type illustrated in FIG. 1.
Figure 3:
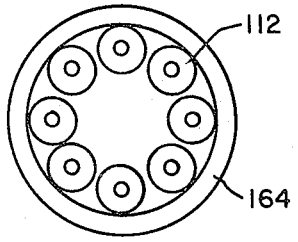
FIG. 3 is a cross-sectional view taken along line 3—3 of FIG. 2.
Figure 4:
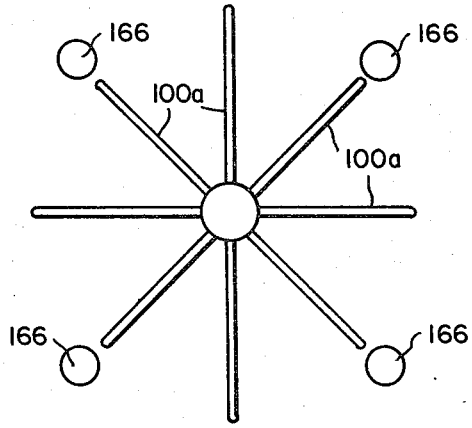
FIG. 4 is a schematic view of the production system of FIG. 2, showing multiple lateral bore holes.

Referring to FIGS. 2–4, a multiple assembly of rolling daiphragm assemblies similar to the rolling diaphragm assembly of FIGS. 1 and 5 is illustrated, such assemblies being arranged concentrically in an oversized bore hole. Each individual rolling diaphragm assembly includes a tubular housing 112, an eversible tube 100, a central pipe 122, and sources of drilling or driving fluids, illustrated schematically by line 162. In the illustrated embodiment, an oversized bore hole is first drilled and a casing 164 is emplaced by conventional means. Eight individual housings 112 are arranged in a circle interior of the bore hole and near the bottom of the oversized hole as illustrated. Alternatively, all of housings 112 may be placed near the earth surface and drilling performed from each housing individually in the manner illustrated in FIGS. 1 and 5. In the embodiment illustrated in FIGS. 2–4, the individual eversible tubes 100 each are programmed to turn in a specific horizontal direction forming a radial array as illustrated in FIG. 4. Vertical production hole casings 166 of conventional construction are provided adjacent the outer extent of the lateral holes. As is conventional, after the lateral portions 100*a* of tubes 100 are radially positioned as shown in FIG. 4, production fluid, such as steam, may be directed through the central passageway and forced into the formation to drive oil from the formation into the production hole casings 166. Alternatively, production holes 166 may also have lateral arrays of holes so as to permit greater spacing between production and injection wells.

The system of FIGS. 2–4 may be broadly construed to include first drilling a main bore hole into an underground formation with a conventional rotary drill, withdrawing the drill, casing the main drill hole, and thereafter forming one or more lateral bore holes projecting from the main bore hole by the system illustrated in FIGS. 1 and 5. In one system of this type, a drilling fluid is pumped continuously through the cased main bore hole, through and out a moveable pipe laterally projecting from the main bore hole to drill the formation in a lateral direction and to form cuttings. The drilling fluid and cuttings define a slurry. The pipe is moved progressively in a lateral direction as the formation is drilled in its path. The pipe is kept out of substantial frictional engagement with the formation by the eversible tube as the pipe moves along this path. The eversible tube may be placed at the lateral turn by movement from the earth formation surface to the lateral turn connection or by placement as an assembly or cartridge of the type illustrated in FIG. 2.

Figure 7:
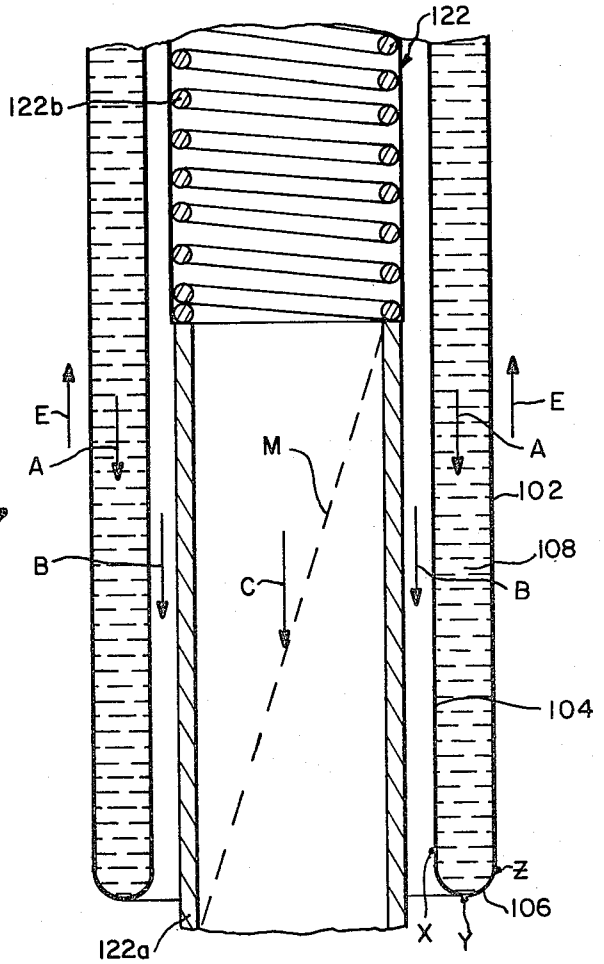

Referring to FIGS. 7 and 8, an expanded view of the forward end of the eversible tube 100 is illustrated with driving fluid in tube 100 indicated by the arrow A in annular portion 108. As illustrated, drilling fluids moving in the direction of arrows B and C are pumped downwardly through central pipe 122 and the zone between inner wall 104 and central pipe 122. One preferred form of central pipe 122 includes a forward segment 122*a* of a relatively rigid and nonporous material connected at its rearward end to a flexible metallic helical segment 122*b* capable of bending or flexing to change direction in response to application of a bending moment to segment 122*b*. Helical segment 122*b* is liquid permeable and, as set forth below, is capable of forming an interior permeable support wall for casing the bore hole, which is drilled by drilling fluid passing through central pipe 122 and against the formation of central pipe 122.

Referring to FIGS. 9 and 10, a detailed view of stabilizer 126 is illustrated, together with outer shroud 128, and axially aligned fins 130, in the form of a cross, which provides a bearing surface for rollover area 106 to bear against and stabilize the overall system. In the illustrated embodiment, fins 130 define arcuate spaces between central pipe 122 and shroud 128 for passage of the drilling fluid. Fins 130 interconnect central pipe 122 with shroud 128. Spaced, ring-like enlarged portions in the form of circumferential ferrules 168 are provided, comprising ridges on the outer surface of central pipe 122. Ferrules 168 create friction bearing surfaces for contact with the inner wall 104 to provide flow constrictions and annular orifices between the inner surface of wall 104 and the outer faces of ferrules 168. In this manner there is an acceleration of the fluid through the orifices, creating a difference in fluid pressure across the ferrules and axial forces which tend to urge central pipe 122 in a forward direction. In general, such ferrules are not required as central pipe 122 moves forward sufficiently without them because of friction between surface 104 and itself.

Referring again to FIG. 9, a relatively small diameter rigid centering rod 170 may be disposed in the interior of central pipe 122, rod 170 being of a substantially smaller diameter than the central pipe and serving to provide further stability for central pipe 122 against sideward deflection. As illustrated, this relatively stiff rod, suitably formed of rigid plastic or metal, includes a forward spike portion 170*a*. (In the alternative, it is possible to form the rod into a hollow tube open at both ends, and to provide fluid flow through it.) The rod is carried forwardly by the friction of flow within central pipe 122 into the formation like a leading spike. Rod 170 may be turned in a predetermined direction by various guide means as set out below.

A significant feature of the present invention is the ability to guide eversible tube 100 along a predetermined path or remotely controlled change of direction as the rollover area 106 moves forwardly. A guidance means may be mounted to any portion of the forward end of the apparatus, including stabilizer 126, the forward end of central pipe 122, including spike 170, or to the eversible tube.

Figure 11:
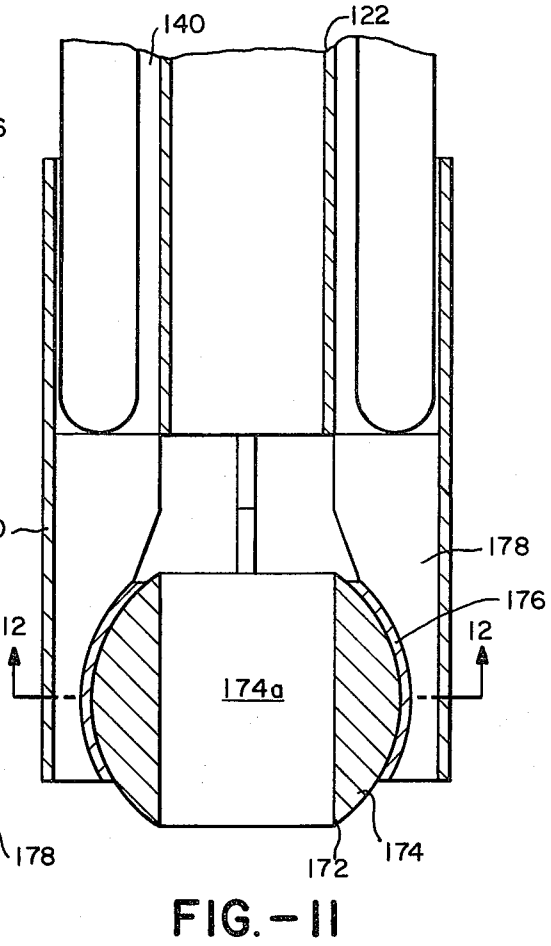
FIG. 11 is a view similar to FIG. 9 but showing a nozzle carried on the forward end of the central pipe for directing fluid flow through the central pipe.
Figure 12:
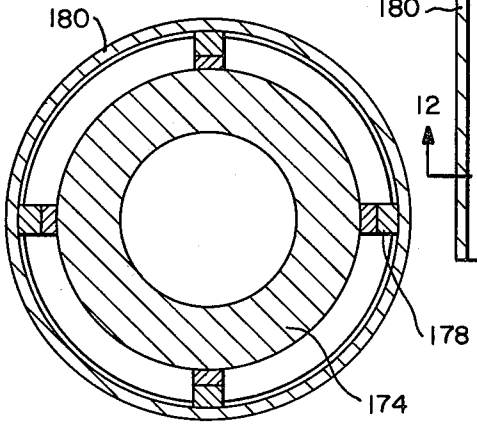
FIG. 12 is cross-sectional view taken along line 12—12 of FIG. 11.

Referring to FIGS. 11 and 12, one means for altering the direction of movement of central pipe 122 is illustrated, which utilizes flow diversion means for selectively altering the direction of drilling fluid issuing from the forward end of the central passageway. In the illustrated embodiment, such flow diversion means comprises rotatable nozzle means, generally designated by the number 172, including a ball-shaped moveable nozzle member 174 defining a central passageway 174*a*, and seated within a spherical socket 176. As illustrated, socket 176 is mounted to radial fins 178 connected with central pipe 122. An outer cylindrical shroud 180 is mounted to Fins 178. Fins 178 permit the fluid flow in central pipe 122 and that in annulus 140 to mix and converge in advance of the central pipe.

During normal operation, passageway 174*a* is disposed in an axial direction. When a turn or change of direction of central pipe 122 is desired, nozzle member 174 is rotated to the desired direction of turn as by a suitable remote servo mechanism, not shown, and drilling fluid is directed in the new direction. The slurry zone D, illustrated in FIG. 1, is thus formed off center, providing a path of lesser resistance and causing the central pipe and eversible tube to turn in that direction. When the desired extent of the turn is accomplished, as to a horizontal direction, the nozzle may be redirected to an axial line to provide again for straight line movement of the central pipe.

The degree of flexibility of portions of central pipe 122 have a significant effect on the ability of the central pipe and the eversible tube normally to track in a straight line and to readily turn when a preprogrammed guidance mechanism carried by the central pipe is actuated. With respect to straight line movement, it is desirable for the forward end of the central pipe to be relatively rigid or stiff. On the other hand, in the area of the central pipe desired for the turn, it is preferable that such pipe be sufficiently flexible to make the turn, but yet be sufficiently rigid to provide a stong framework for use as the ultimate casing of the resulting bore hole. An excellent flexible material for this purpose is a cylindrical steel helix. It has been found that for axial stability it is preferable that the rigid forward portion of the central pipe have a length about 5 to 25 times the diameter of inner wall 104. The maximum length of the rigid portion is determined by the radius of curvature of the desired bore hole which is acceptable during drilling. That is, if forward end 122*a* is totally rigid, the curvature is determined by the cord distance between the forward edge of central pipe 122 along a diagonal line (designated M in FIG. 7) to the end of the rigid portion. The outer extents of line M constitute the contact points with the adjacent tubular portion, and thus determine this turning radius.

Figure 13:
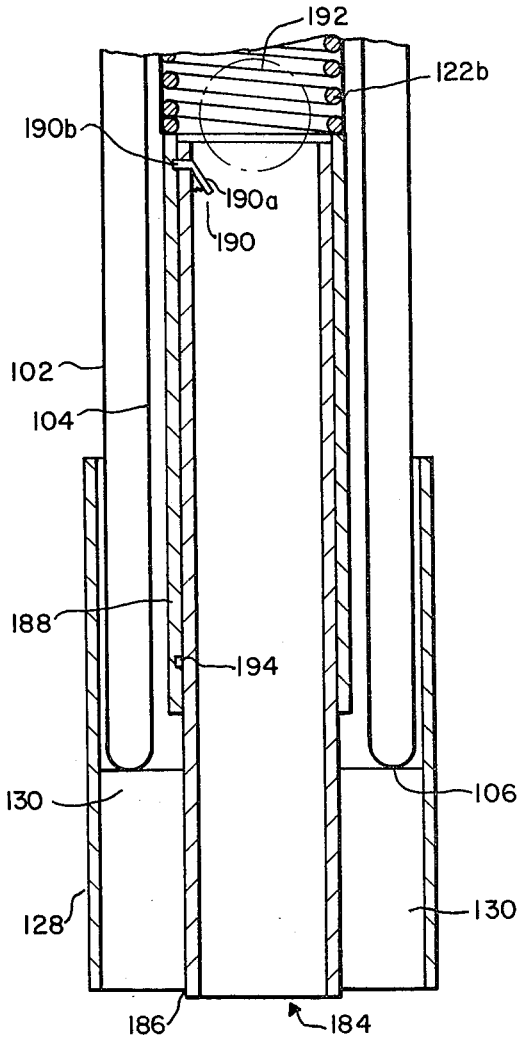
FIGS. 13 and 14 are enlarged, fragmentary cross-sectional views of a telescoping central pipe with a telescoping pipe portion in unexpanded and expanded positions, respectively.
Figure 14:
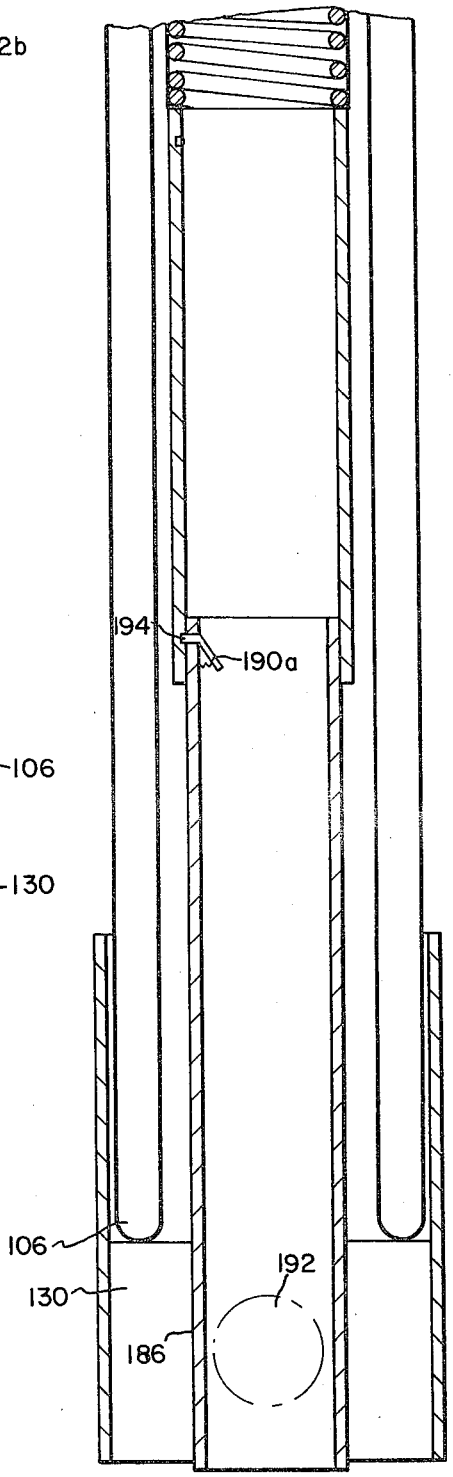

Referring to FIGS. 13 and 14, a telescoping rigid forward central pipe portion, generally designated by the number 184, is illustrated to provide a variable length for the forward end of the central pipe. That is, its normal unextended position, illustrated in FIG. 13, is relatively short to provide a correspondingly short turning radius and after the turn, it may be extended as illustrated in FIG. 14 to provide the desired axial stability.

In the illustrated embodiment, telescoping pipe 184 includes an inner pipe portion 186 telescopically received in an outer pipe portion 188 connected to a portion of the flexible central pipe 122 in the form of a helix. As illustrated, a trigger mechanism 190 is mounted to extend through the upper portion of inner pipe portion 186, and includes a spring mounted trigger arm 190*a* in portion 186 and a moveable stop arm 190*b*, which removably seats into a recess in outer pipe portion 188. Trigger mechanism 190 may be actuated by passing a ball 192 of suitable diameter downwardly through the central channel of inner pipe portion 186 from the surface, as illustrated in FIG. 14 and then into the formation. Upon triggering, pipe 186 moves forwardly in response to drilling fluid pressure, until stop arm 190*b* is seated in recess 194 of outer pipe portion 188. Thereafter, the rollover area 106 continues to bear against the upper edge margins of fins 130. Other trigger mechanisms may be employed to actuate the movement of portion 188 relative to portion 186.

Figures 15, 16:
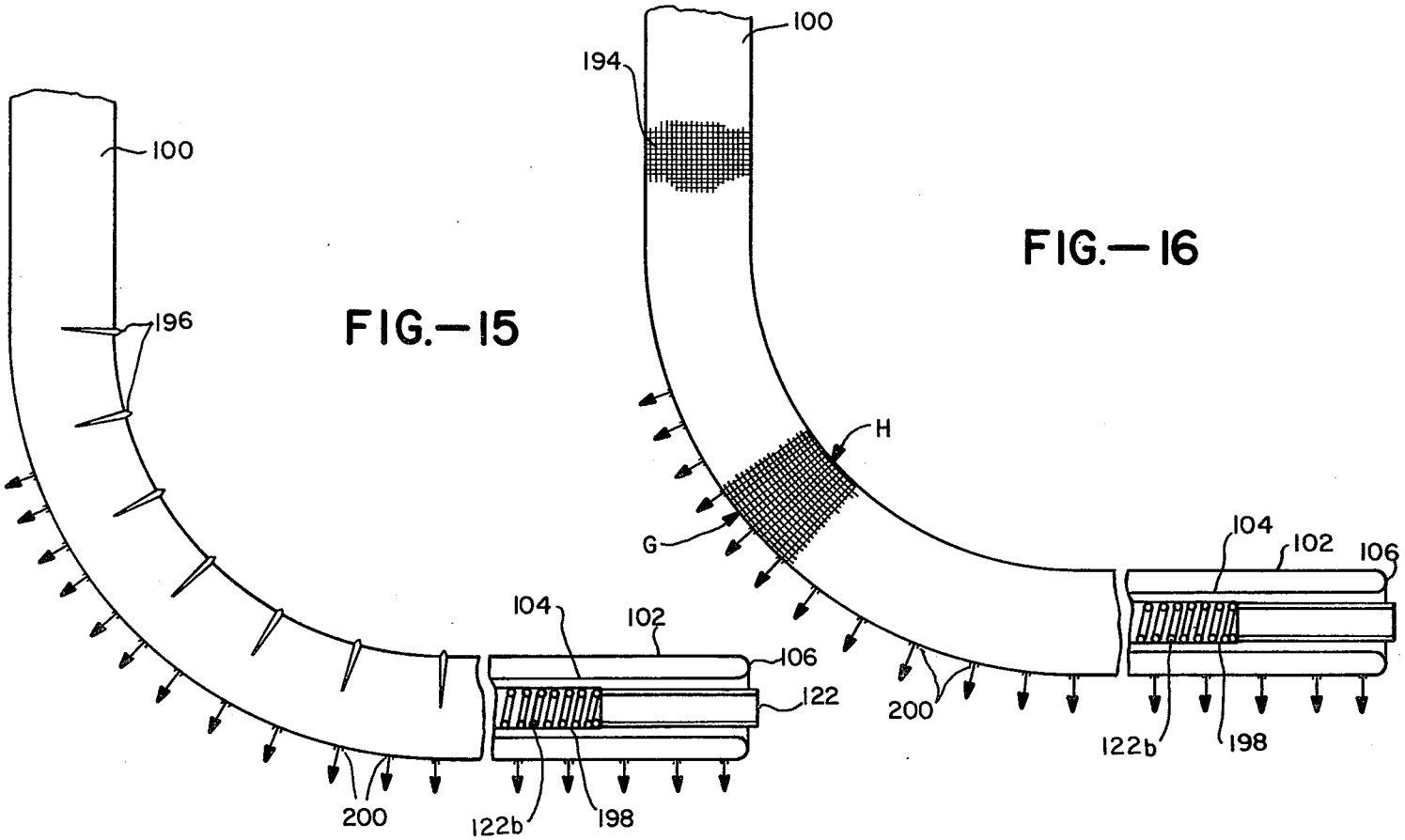
FIG. 15 illustrates an enlarged, fragmentary side elevational view of a turning segment of the rolling diaphragm or eversible tube with pre-programmed darts thereon and fluid outlet openings.
FIG. 16 is a view similar to FIG. 15 but illustrating the eversible tube formed from a fabric having an asymmetric weave.

Referring in general to FIGS. 15 and 16, two different modes for causing a turn to be made by tube 100 are illustrated in which tube 100, in effect, comprises turning segments formed axially in the tube, initially disposed on inner tube wall 104 and then moving through rollover area 106 to the outer tubular wall. The most desired material for this type of turning mechanism is a strong woven fabric-like material, woven in a perpendicular or orthogonal configuration, illustrated as segment 194 in FIG. 16. This type of configuration avoids twisting of the material because the minimum energy condition is for the axial (warp) part of the fibers to remain axial while the other fibers (fill) remain circumferential. It has been found that tubular cloth material of this type does not twist with the individual axial fibers in a highly stable axial direction, so that the turning segments remain in the same angular orientation with respect to the axis of the tube 100 during drilling. This means that a preprogrammed turn using a tube of this type is highly predictable. Suitable high strength fibers for use with the tube can be of the nylon or aramid (aromatic polyamide) type which may be further reinforced. Suitable aramid materials are sold under the trademark Kevlar 29 or 49, by Du Pont. The properties of these types of material are illustrated in R. Ford, *Science and Technology,* September 1968, p. 19. Other high strength fibers, such as polytetrafluoroethylene, may be used alone or in combination with the nylon or aramid fibers in the warp or fill directions.

Referring again to FIGS. 15 and 16, the turning segments of tube 100 each include axially spaced strip-like portions (darts) of shortened effective circumferential length compared to the circumference of the turning segment which causes the tube to turn in the direction of the shortened strip-like portion when the inner wall 104 of tube 100 moves through the rollover area. Referring specifically to FIG. 15, the shortened strip-like portions are formed by multiple circumferential sewed in tucks or darts 196 spaced apart axially a predetermined distance along a predetermined partial circumferential distance of the turning segment to provide a turn of the desired radius. Each of the darts, in essence, result from the sewing of a small segment of cloth from the outer fabric surface of tube 100 itself, representing a circumferential fin, which can be as short as a few degrees circumferentially to as long as 180 degrees circumferentially. The effect is to create a shortened side of the tube 100 so that when the inner wall 104 passes through rollover area 106 and becomes the outer wall 102, it exposes a series of darts as illustrated in FIG. 15 to cause the turn to be made. If the darts are mounted against bearing surfaces as illustrated in FIGS. 9 and 10, as they pass through the rollover area, a shortened dart effectively reorients the whole tube to one side to provide polygonal movement rather than a continuous curve. However, the net effect is as illustrated in FIG. 15. In this embodiment, it is preferable to include a permeable or impermeable outer liner 198 on central pipe 122 which serves two distinct functions. Assuming it is desired to maintain differential pressures in drilling fluids travelling through and around central pipe 122, the liner may be impermeable to separate these flows. In addition, the liner provides protection against the darts hooking into helical spring 122*b* while they are on the inner wall.

Referring again to FIGS. 15 and 16, ports 200 are provided on the side opposite the darts to provide jets of driving fluid. In the illustrated turn from the vertical to the horizontal direction such spaced jets are directed to the side opposite the inner turning radius, which constitutes the bottom of the curve. Such jets stir the matrix and reduce the resistance of the matrix to turning. Such jets may also be used to effect circumferential circulation of cuttings from the bottom to the top of the eversible tube to aid backflow of cuttings.

Referring to FIG. 16, another embodiment of a turning segment of tube 100 is illustrated in which the segment is of woven cloth and the cloth is woven asymmetrically. That is, the picks per inch, or yarns per inch, in the fill (the circumferential direction) are woven such that the spread on one side of the tube between the yarns is greater than on the other side. Specifically, the spread is greater on the bottom side, indicated by arrow G in FIG. 16, than on the top side, illustrated by arrow H. In this manner, the tube tends to turn in the illustrated direction. If desired, a preprogrammed turn may be spliced into the eversible tube.

Figure 18:
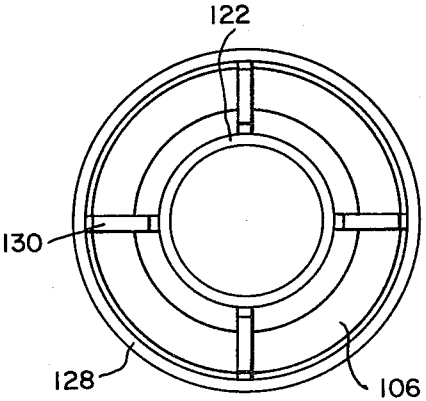
FIGS. 18 and 20 are views taken along lines 18—18 and 20—20 of FIGS. 17 and 19, respectively.
Figure 17:
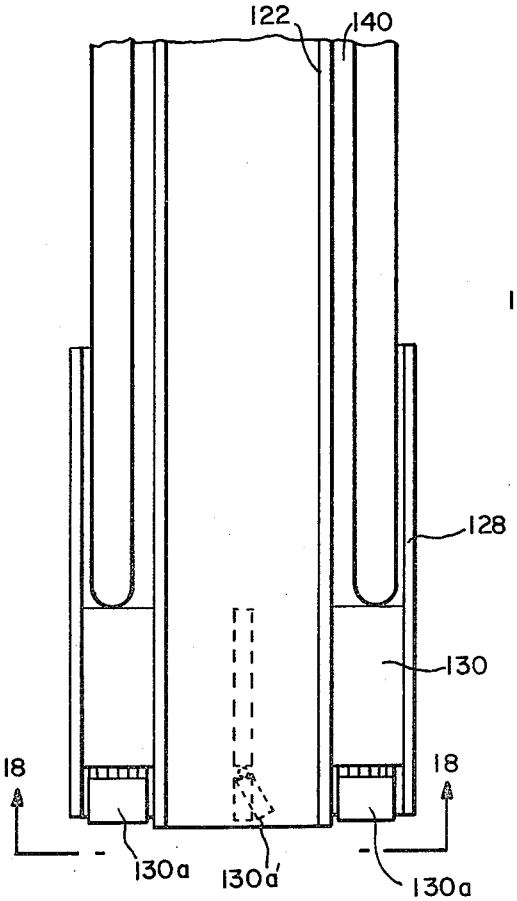

Referring to FIGS. 17 and 18, another mode of turning central tube 122 is illustrated which includes diverting of fluid flow in the vicinity of the forward end of the central pipe to form a slurry in a preferential area ahead of the central tube which minimizes formation resistance in that direction and thus causes the central tube to turn in that direction. In this instance, moveable fin means is provided on the forward end of the central pipe. The rigid vanes or fins 130, described above, interconnecting central pipe 122 and shroud 128, each include radially disposed and axially directed fin portions 130*a* pivotally mounted to the forward end of rigid fins 130 and comprising the moveable fin means. When fin portions 130*a* are axially disposed, the system moves in a straight line in a direction axially of the central tube. When fin portions 130*a* are pivoted to a slanted position as illustrated in phantom in FIG. 17, the fluid flow from annulus 140 is directed in the preferred direction to cause turning of the central pipe. Such vanes may be actuated by any suitable means (not shown) such as a remote controlled servo mechanism, or may be actuated like an airplane control surface with cables and levers.

Figure 19:
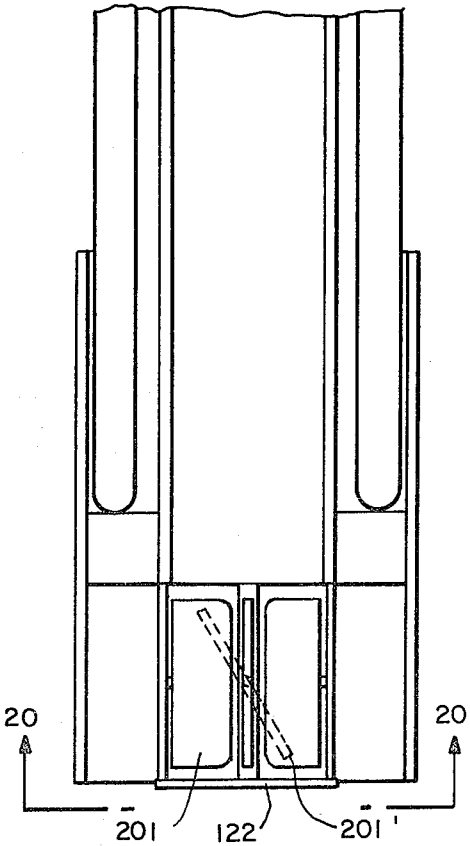
FIGS. 17 and 19 are views similar to FIGS. 9, 11 and 13, but illustrating two different embodiments of the central pipe using vanes for altering the direction of fluid flow through the central pipe.
Figure 20:
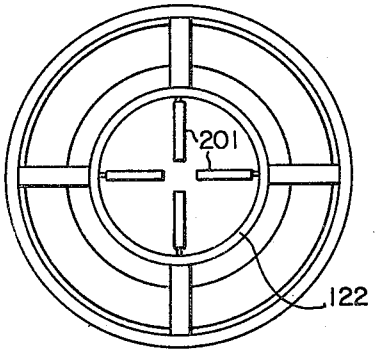

Referring to FIGS. 19 and 20, a similar moveable fin apparatus is illustrated in which moveable fins 201 are mounted internally of central pipe 122. Such moveable fins 201 may be pivotally mounted to the interior surface of the central pipe to project inwardly towards a center in the form of a cross. When they are axially disposed, as shown in FIG. 20, the fins cause the central pipe to travel in a straight line. However, when pivoted to a sloping position off the axial, as illustrated in phantom at 201' in FIG. 19, the fins cause the flow to travel in that direction of the slope to turn the central pipe in accordance with the principles described with respect to the embodiment of FIGS. 17 and 18.

Figure 22:
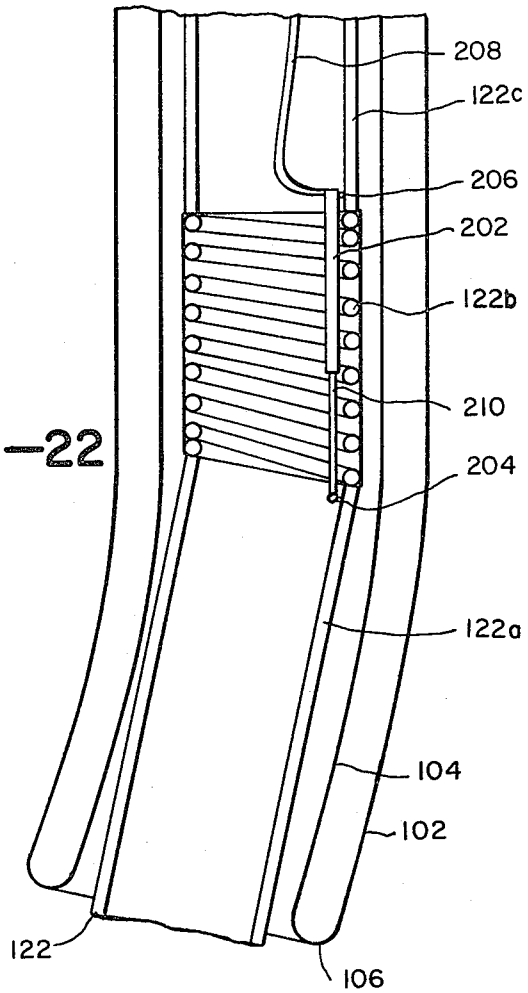
FIGS. 21 and 22 are views to FIGS. 9, 11, 13 and 17 but showing a central pipe utilizing a fluid piston and cylinder assembly to expand one side of a flexible helix forming a part of the central pipe to accomplish a turn.
Figure 21:
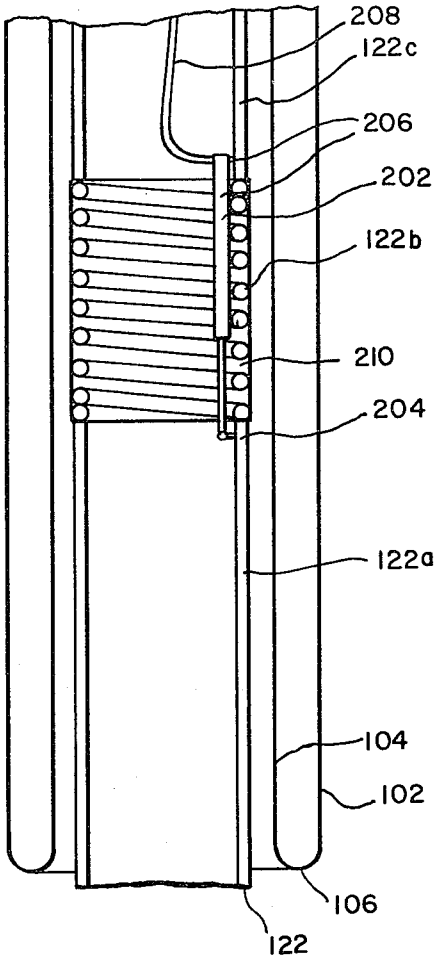

Referring to FIGS. 21 and 22, another guidance system is provided for turning central pipe 122 based upon bending forces exerted on the central pipe. Rigid forward pipe segment 122*a* is connected to flexible helical segment 122*b* and then to another rigid segment 122*c* to the rearward end of segment 122*b*. The principles of operation is that expansion means bears on flexible spring segment 122*b* in only a selected partial circumferential section. As the expansion means is capable of elongating in an axial direction, it creates a bending moment to deflect the central pipe to thereby turn it in a desired direction.

Referring specifically to FIGS. 21 and 22, the expansion means comprises an axially disposed expandable fluid actuated or hydraulic piston and cylinder assembly 202, mounted between stationary mounting points 204 and 206 on rigid pipe portions 122*a* and 122*c*. Means is provided for supplying fluid under pressure in line 208 to assembly 202 to expand piston rod 210 from its unextended position in FIG. 21 to an extended position in FIG. 22. In this manner, one side of a flexible steel helix is expanded to increase its spacings per turn, and in effect, stretch that one side to bend it and thereby deflect a stiff forward portion 122*a*, which in turn redirects the central drilling fluid and results in a redirection of the central pipe as set out above. It is preferable to mount assembly 202 against two rigid members at opposite sides of the flexible portion to provide maximum servo capacity.

Figure 24:
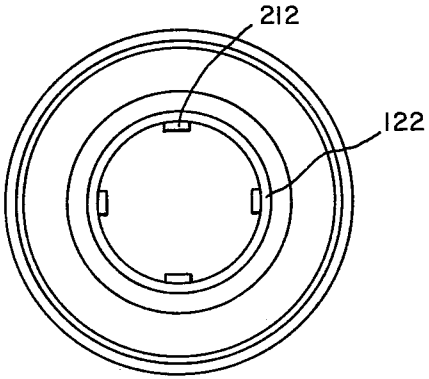
FIG. 24 is an end view of the drilling unit of FIG. 23.
Figure 23:
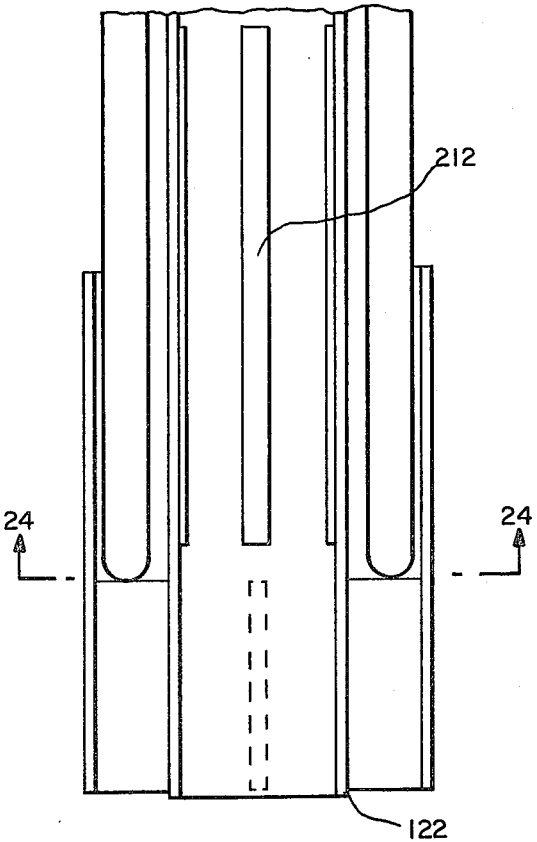
FIG. 23 is a view similar to FIGS. 21 and 22 but showing the use of heating elements in the form of strips on the inner surface of a central pipe portion of heat expandable material.

Referring to FIGS. 23 and 24, another mode of deflecting the central pipe 122 is illustrated, which includes multiple axially extensive strips 212 mounted on the inner surface of central pipe 122 at suitable circumferential spacing (e.g., a total of four, one in each quadrant). In one embodiment, strips 212 are electrical heating elements, and the central pipe near the strips is formed of thermally expandable material. One side of the rigid tube is preferentially heated and thus expanded to, in turn, deflect drilling fluid and turn the central tube as illustrated above. In another mode, such strips are formed of a deformable material, such as the alloy sold under the trademark Nitinol, formed of nickel and titanium, or Beta metal, another deformable material. These alloys have a shape memory based upon a thermal induced phase transformation so that by changing the temperature of the material, as with an electrical heating current, or by using heated drilling fluid, the strips deflect to their predetermined shape in memory, causing the central pipe to be bent to thereby deflect fluid flow as set out above.

Figure 25:
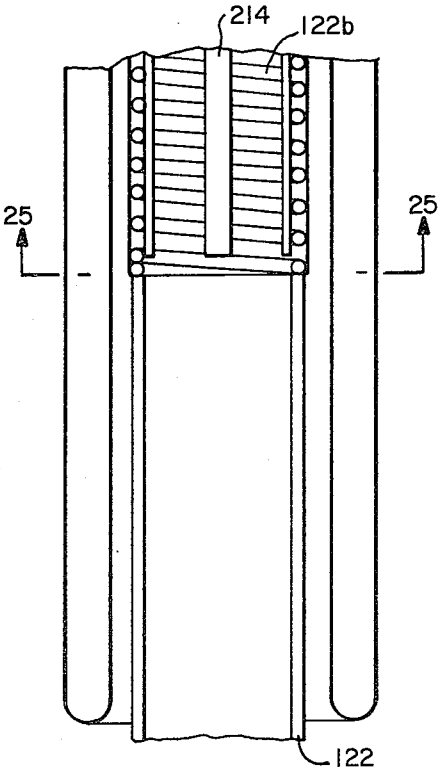
FIG. 25 is a view similar to FIG. 24 but showing heating element strips on a flexible, helical portion of the central pipe.
Figure 26:
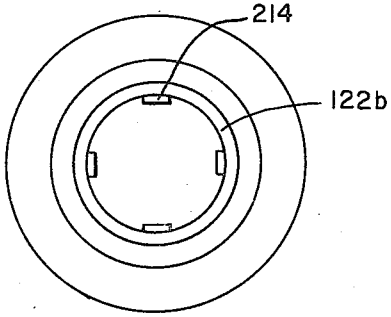
FIG. 26 is an end view of the device of FIG. 25.

Referring to FIGS. 25 and 26, radially spaced axially aligned strips 214 are mounted in each quadrant of the flexible helical spring portion 122*b* of central pipe 122. In the illustrated embodiment, such strips are mounted internally of helical spring portion 122*b* and are used to turn portion 122*b* in the manner set forth above.

Figure 27:
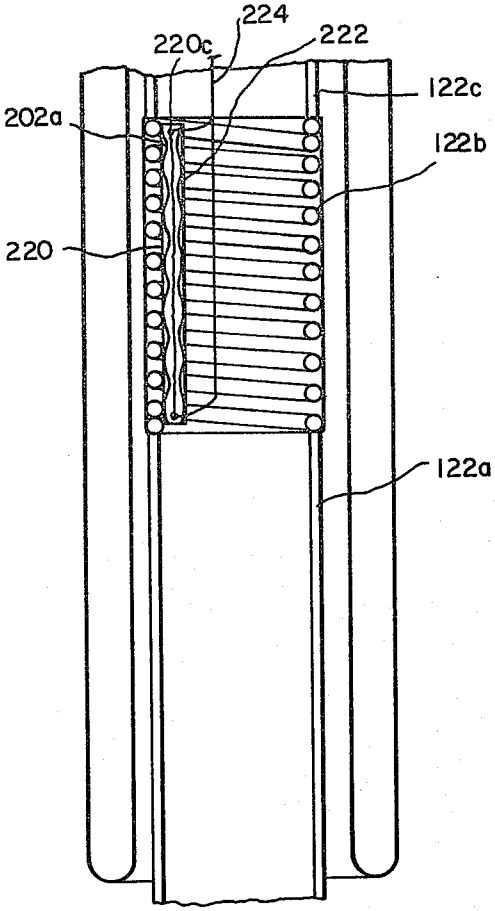
FIG. 27 is view similar to FIG. 25 but showing an expandable bellows device for turning the helical portion of the central pipe.

Referring to FIG. 27, another linear deflection mechanism is illustrated, similar in function to that illustrated in FIGS. 24 and 25. Specifically, a metal bellows container 220 is axially mounted to the interior wall of flexible central pipe portion 202*a*. A rigid supporting cylindrical shroud 222 is provided to the bellows exterior to prevent it from expanding or buckling. A heat expandable material such as paraffin is contained within the bellows. Typical electrical heating means 224 is provided for the bellows to create axial expansion at a predetermined circumferential location on portion 202*a* to deflect the latter and thereby turn the central pipe in the manner set forth above. Shroud 222 includes an inner surface close to the adjacent surface of the bellows and includes sufficient rigidity to prevent the bellows from buckling. This provides preferential expansion in an axial direction. The bellows container 220, in effect, pushes against stiff central pipe segments 122*a* and 122*c* to cause axial deflection of helical segment 122*b* to thereby cause the central device to turn as set forth above.

Figure 29:
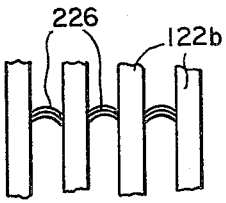
FIGS. 29 and 30 are enlarged, fragmentary, side elevational views of the helical segment of FIG. 28 showing the bimetallic strips contracted and expanded, respectively.
Figure 30:
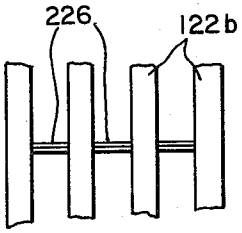
Figure 28:
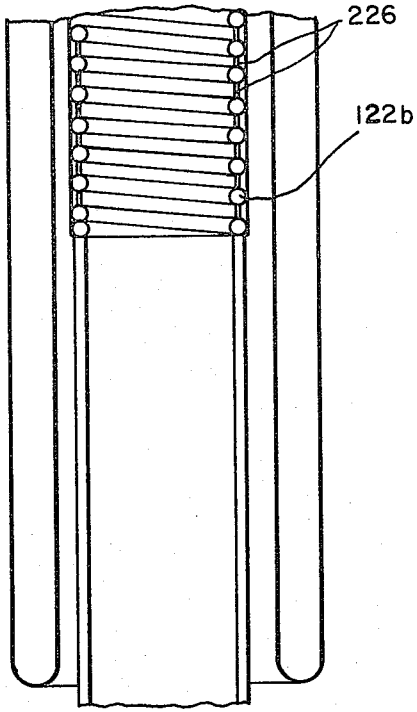
FIG. 28 is a view similar to FIG. 27 but showing the use of bimetallic strips placed in a flexible helical segment of the central pipe for turning the central pipe.

Referring to FIGS. 28–30, another mode of deflecting flexible central pipe portion 122*b* is illustrated, including the use of bimetallic strips 226 disposed between adjacent turns of the helical spring segment 122*b*. Such bimetallic strips are of different thermal expansion properties. By heating strips in differential segments, the helical portion 122*b* may be deflected to provide turning of the central pipe as set forth above. Specifically, FIGS. 29 and 30 illustrate the strips in two different shapes depending upon the heat applied. In FIG. 30, the maximum axial expansion is shown. Means is provided for heating the strips to cause them to bend and thus deflect. Such means may comprise a heated drilling fluid itself or electrical heating means, not shown.

Figure 32:
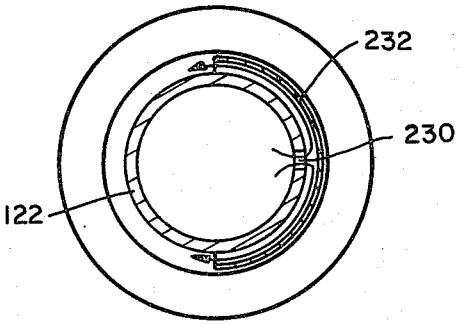
FIG. 32 is a cross-sectional view taken along line 32—32 of FIG. 31.
Figure 31:
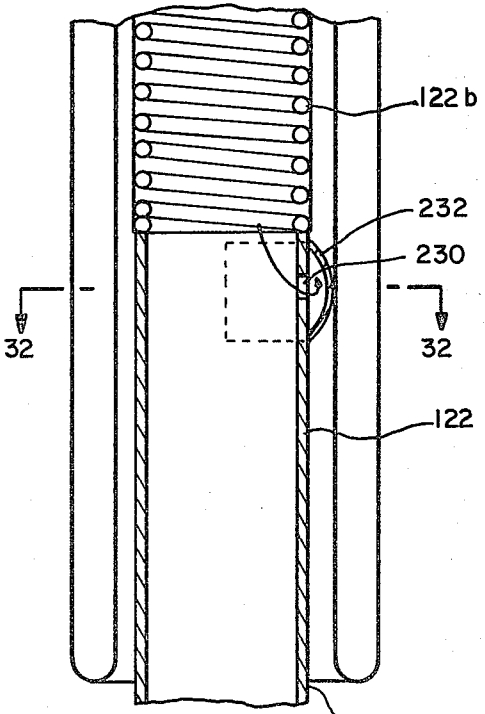
FIG. 31 is a view similar to FIG. 28 but showing a port in the side of the central pipe to permit drilling fluid to flow through the port to effect the turning or flexing of the central pipe.

FIGS. 31 and 32 illustrate another mode of turning central pipe 122. Specifically, port means is provided in the central pipe in the stiff forward pipe portion 122*a*. Such port means includes a port or opening 230 in a selected location on portion 122*a*, specifically at one quadrant only. The port is normally closed by port closure 232 and may be opened to provide a radial thrust to shift portion 122*a* and change direction of the central pipe. In the illustrated embodiment, the port closure includes a releasable latch, not shown, which is actuated to an open position by predetermined fluid pressure within the central pipe. Thus, by increasing that pressure, the port may be opened to provide a radial thrust exerted on the central pipe.

In another embodiment, not shown, the port closure may comprise a meltable plug, which is actuated to an open position by increasing the temperature of the drilling fluid.

Figure 33:
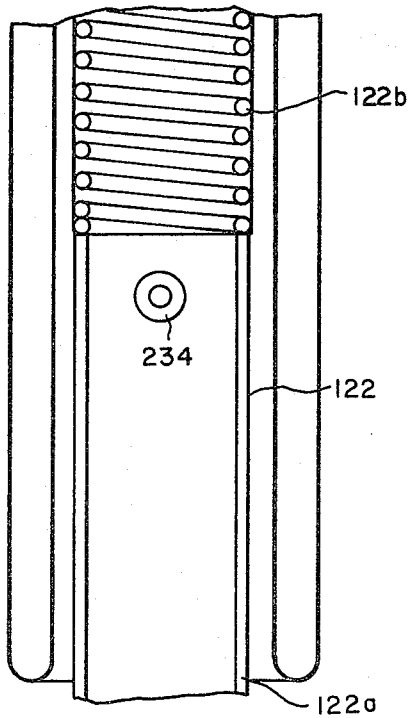
FIG. 33 is a view similar to FIG. 31 but showing a sphincter valve in a side port of the central pipe.
Figure 35:
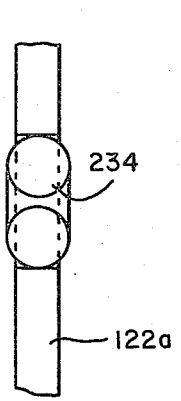
FIGS. 34 and 35 are enlarged, cross-sectional views of the central pipe of FIG. 33, showing the sphincter valve contracted and expanded, respectively.
Figure 34:
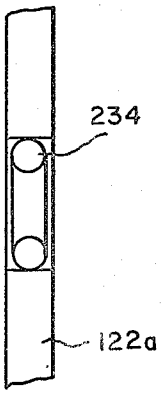

Referring to FIGS. 33–35, another embodiment for turning central pipe 122 utilizing fluid pressure is illustrated in which a sphincter valve, normally surrounding a port in the central port but not blocking flow and actuatable to a closed flow restricting position, provides a radial thrust in accordance with the principles set out with respect to FIGS. 31 and 32. Specifically, the sphincter valve comprises a number of inner tube-like expandable hollow rings 234 in respective openings in the quadrants of the central pipe. Within the rings, expandable material, such as paraffin, may be employed. By heating that material, the material expands in the rings, causing the holes in the rings to decrease in diameter. This causes a lessor amount of drilling fluid to pass through one or more rings to create a thrust in a preferential circumferential location to deflect the central pipe. Heating may be accomplished by an electrical heating element in or near each ring or by heating the drilling fluid to a sufficient extent to expand the paraffin to close the valve.

Figure 37:
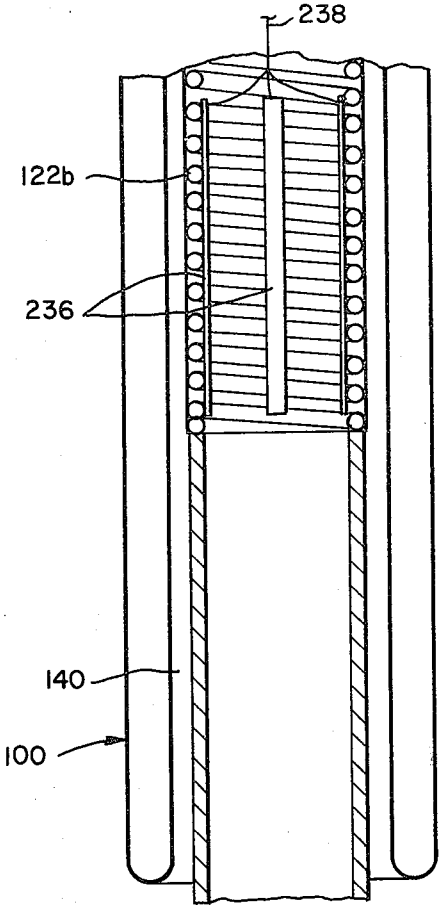
FIGS. 36 and 37 are views similar to FIG. 33 but showing strain gauges on the central pipe for detecting its direction of turning or movement, FIG. 36 showing the strain gauge attached to a forward rigid portion of the central pipe, and FIG. 37 showing the strain gauge connected to a helical portion of the central pipe.
Figure 36:
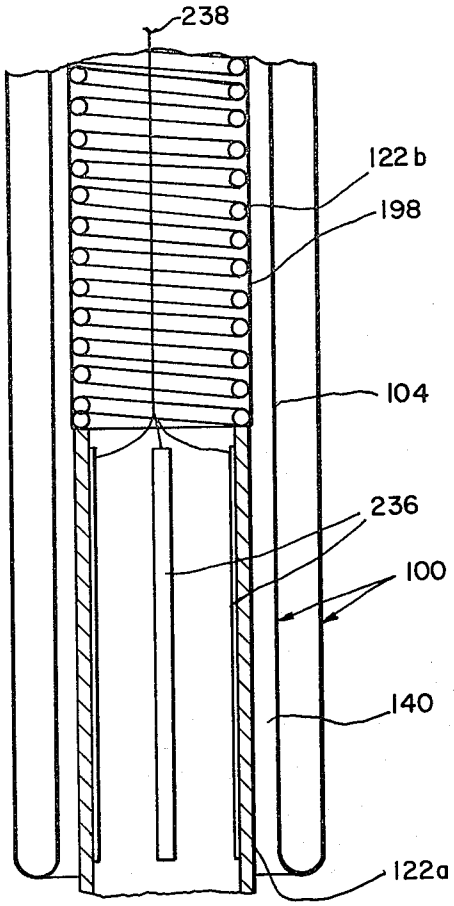

Referring to FIGS. 36 and 37, locating means is illustrated in the form of strain gauges 236 mounted on the inner surface of the rigid forward central pipe portion 122*a* and the central pipe helical spring segment 122*b*, respectively, and including line 238 to transmit the electrical signals from the strain gauges to a remote location on the surface. Such strain gauges may be either solid state or resistance elements, mounted on respective quadrants of the spring segment. Each strain gauge constitutes part of a separate Wheatstone bridge, or balanced bridge. When the portion of the central pipe to which one of the strain gauges is attached is deflected axially, such deflections are sensed by the one strain gauge and thus measured, recorded, and integrated to provide a complete record of the direction in which the central pipe is turning.

Figure 39:
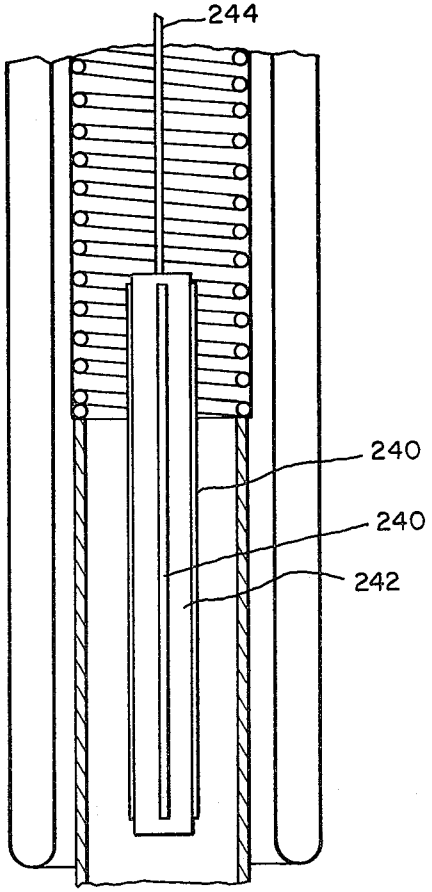
FIG. 39 illustrates a strain gauge of the type illustrated in FIGS. 36 and 37 but carried independently of the central pipe.

Referring to FIG. 39, the strain gauges are in the form of strips 240, axially mounted in quadrants of a free body 242, connected by a line 244 to the surface. Next, by dropping body 242 through the system before, during or after the bore hole is formed, and measuring the length of the wire 244 which is played out and the integrated deflections of the strain gauges, the location of the central pipe can be monitored.

Figure 38:
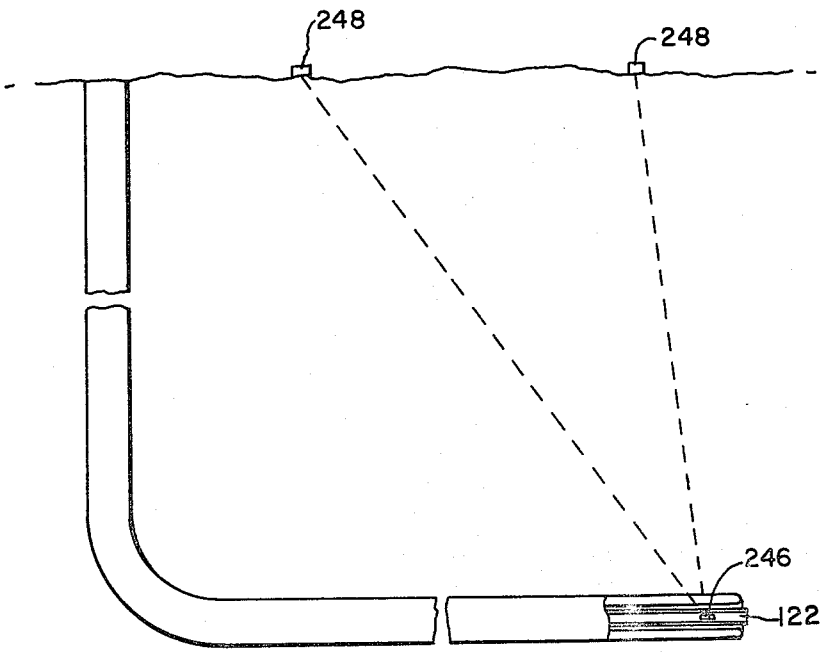
FIG. 38 illustrates a side elevational view partially in section, of a signal generating device in the forward end of the central port and a remote receiving station for receiving signals for locating the generating device.

Referring to FIG. 38, another locating means for the central pipe is illustrated. Means 246 for generating a signal, such as of the acoustical, electrical, electromagnetic or seismic type, is mounted at the forward end of central pipe 122 and serves as a transponder. Means is provided for receiving or sensing the signal at surface stations 248 to locate the forward end of a triangulation basis.

If desired, a fluid pressure actuated rotating drill (such as Moineau pump used as a drill of the type sold under the trade designation Dyna-Drill, by Smith International, Inc. of Irvine, Calif.) may be mounted to the forward end of central pipe 122 to break up limited amounts of consolidated formation. Such drill is either placed down the bore hole only if needed or may be permanently mounted but not actuated until consolidated material is reached. The drilling fluid passes through central pipe 122 and into the formation.

As set out above with respect to FIG. 15, an external liner 198 may be provided for helical segment 122*b* to prevent fouling of the inner tubular wall 104, especially where darts 196 are employed on eversible tube 100. If desired, a liner may be included on the interior of segment 122*b* rather than the exterior for specific applications. Typically, the liner is liquid impermeable and serves as a barrier between the flow in annulus 140 and within the central pipe.

In accordance with the present invention, the mineral matrix of the underground formation is fluidized by drilling fluid exiting the nozzle outlet and by driving fluid weeping through the porous eversible tube along the tube. This causes sorting so that when the eversible is in a horizontal position a bed or foundation of the coarse particles is continuously deposited below the tube, similar to a moving concrete slip form. This foundation provides support and corresponding stability of motion in the horizontal direction.

For the recovery of oil from an oil-bearing formation, the drilling fluid and the driving fluid form a slurry with the solids and fluids comprising the medium or formation. This formation will typically contain oil and solid mineral particles. In general the oil may be present as an oil-wet or water-wet system with respect to the mineral particles. The oil-water mixture residing in situ before drilling typically is oil-continuous, that is, the oil may be distributed within the pore space in such a way as to form a continuous phase within which solids and water are dispersed. Because of its high viscosity and high resistance to flow in this form, the three-phase system residing in situ is transformed by the drilling fluid and/or the driving fluid into an oil or water-continuous slurry in which oil and particles are dispersed.

A variety of different drilling fluids may be used, such as aqueous or oil-based fluids, and a range of low to high viscosity fluids. Oil or an oil-based solvent can be used to facilitate penetration into certain formations. In other formations, it may be desirable to use an aqueous-based drilling fluid to emulsify the oil phase.

Emulsification of the oil phase may be accomplished by mechanical, fluid-mechanical, or physical-chemical means. This may be accomplished by various combinations of the following mechanisms: (i) exerting mechanical shear on the interface between oil-continuous media and the drilling and/or driving fluid; (ii) lowering the viscosity of the oil; (iii) lowering the interfacial tension between oil and these fluids; (iv) lowering the forces of electrostatic origin which favor the stability of this interface; or (v) providing a fourth (gaseous) phase which favors the reformation of oil molecules into a dispersed phase.

In this invention, mechanical shear is exerted at the interface by the relative motion between mobile drilling/driving fluid and/or water-continuous slurry, and the immobile oil-continuous formation to be mined. The drilling fluid may include chemicals other than water, which by their surface activity (surfactants), may lower the interfacial tension between oil and water, or may form a third phase, distinct from oil or water, consisting of micro-emulsions of oil and water. By appropriate choice of ionic strength, temperature, and composition, this micro-emulsion phase may result in an interfacial tension between bulk oil and bulk water which is very low.

One preferred aqueous drilling fluid includes an aqueous monovalent alkali metal (e.g., sodium) hydroxide or salt solution at an alkaline pH of at least 8.5, and preferably 11.0, or a monovalent acid solution at a pH of no greater than 5.5, and preferably 3.0. This system is found to form a surfactant in situ to thereby assist breaking up the structure of the formation and to form a slurry. In addition the acid or base serve as sources of high ionic strength to accomplish the beneficial effects of electrostatic destabilization of the oil-water interface as set out above. In that regards, salts such as sodium chloride in salt water serve a similar destabilizing effect but may cause complexing problems. The effect of ionic strength on the oil-water interface is described in Verwey and Overbeck, *The Theory of the Stability of Lyophobic Colloids,* Elsevier Publishing Co., 1948.

Another drilling fluid system includes as a surfactant sulfonated salts of oil molecules. The oil molecules are chosen to approximately match the functional characteristics, e.g., the ratio of aliphatics to aromatics, of the oil in the formation. Use of these sulfonates at a concentration of about 0.01 to 0.1 gm/100 ml water and in the presence of salt (e.g. NaCl at 1 gm/100 ml water) reduces the interfacial tension between the oil and the water to form microemulsions or micellar solutions in accordance with the principles described in W. R. Foster, *Low Tension Flooding Process,* J. Petroleum Technology, Vol. 25, p. 205, 1973.

In another mode of the invention, air in fine bubble form is pumped into the drilling fluid and assists in the formation of the surfactant, such as a sulfonate formed from the natural constituents of the oil, and also serves as a hydrophobic nucleus for the agglomeration of oil in the slurry. This, too, assists the separation (flotation) of oil from the water and provides the air for an airlift pump. A preferred concentration of air is about 5,000 to 10,000 or more cu.ft. STP/barrel of oil.

In a specific aqueous drilling fluid system, 0.05 to 0.1 molar sodium hydroxide or sodium silicate is utilized for a fresh water system. If salt water is employed in the drilling fluid or is present in the formation, then a water softening aspect is preferably also included, such as trisodium phosphate. It is noted that use of the above system, together with pumping air in fine bubble form, provides an excellent production fluid as well as a drilling fluid. In this instance, the effect of the air agglomerating the oil is particularly important as it assists in separation of the oil from the water. Also, as set out above, it provides a natural air lift pump.

Another important aspect of the drilling fluid is that it be at an elevated temperature, (e.g. at least 150° F. to 180° F.) sufficient to significantly reduce the viscosity of the oil in the formation to facilitate formation of the slurry.

Another application for the drilling system of the present invention is the recovery of the heating valve of geothermal steam in earth formations. Here, the eversible tube is used to drill a path from the earth surface to a geothermal steam region and back to the earth surface (e.g., as shown in FIG. 1). Thereafter, a heat transfer fluid, typically water, is pumped from one end to the other of the eversible tube. It is heated as it passes through the geothermal steam region to form hot water or steam and the heat from the hot water or steam withdrawn from the eversible tube is recovered at the surface for uses such as the generation of power. For long term usage, heat resistant materials should be used for the eversible tube (e.g., carbon-containing cloth, as formed of fibers sold under the trademark Thornel by Union Carbide) and central pipe (e.g., carbon fiber-reinforced composite).

Figure 41:
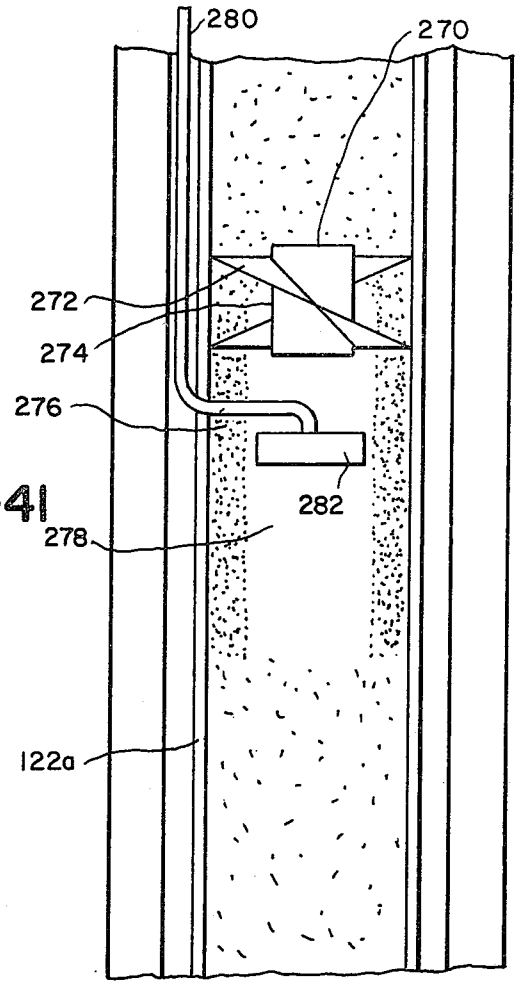
FIGS. 40 and 41 are views similar to FIG. 39 but showing two different embodiments of in-hole steam generating devices carried on the forward end of the central pipe.
Figure 40:
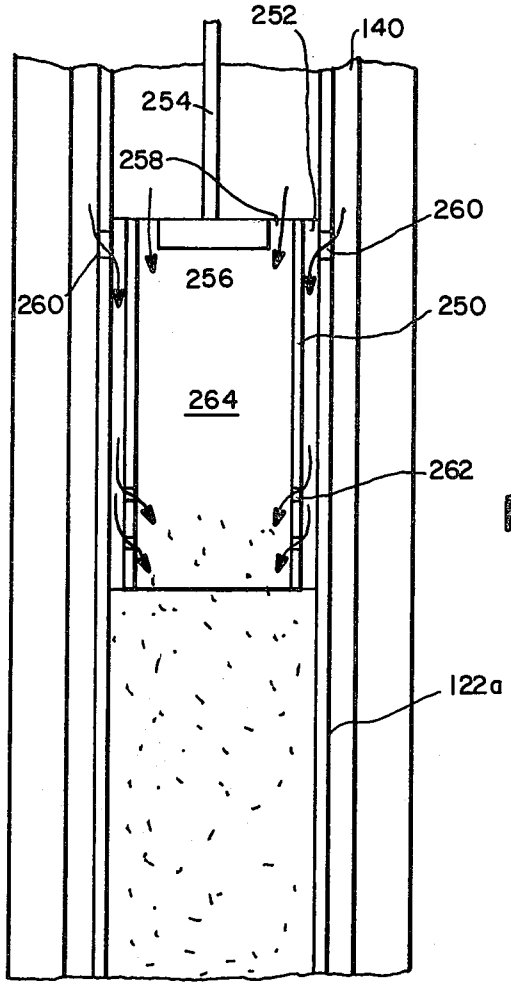

A potentially important tool in the present device or in conventional drilling is a down-hole steam generator. This is because steam injected at the surface loses its thermal energy in the long distances which it must travel down the hole. FIGS. 40 and 41 illustrate two different embodiments of such generators. Referring to FIG. 40, a device is illustrated within the rigid forward pipe segment 122*a*. It includes an elongate hollow, generally cylindrical, tubular body 250, axially aligned within pipe segment 122*a* and defining therewith an annular fluid flow space at 252. An inlet line 254 for combustible fluid is provided with a burner outlet 256 disposed across the top of the body. Inlets 258 are provided in the top of body 250 adjacent burner 256. Ports 260 are spaced around pipe segment 122*a* in the general axial location of burner 256. Ports 260 provide fluid communication between annulus 140 and annular space 252. In addition, multiple ports 262 are provided toward the forward end of the cylindrical wall of tubular body 250 to provide flow communication between annular space 252 and a chamber 264 formed within the tubular body.

In operation of the embodiment of FIG. 40, air is passed through ports 258 while a combustible fluid is burned at burner 256. Water is passed through annulus 140 and into annular space 252 and then into the forward end of chamber 264, where it is formed into steam by the heat from the gases in burner 256. Passage of the water around a portion of that annular space 252 provides an annular cooling layer for the tubular body. In another embodiment, not shown, water may be redirected upwardly by a suitable barrier in a second pass around the combustion chamber to provide a double wall of cooling. It should be further understood that while the down-hole generator is illustrated within the structure of the present invention, it could also be utilized in a conventional bore hole system.

Referring to FIG. 41, another down-hole steam generator is illustrated, including fixed axially aligned fan-like vane means 270, mounted centrally in central pipe 122*a*. The vane means includes generally spiral vane 272 mounted to a central cylindrical body 274. A combination of drilling fluid with entrained air of the type described above is passed downwardly and is separated by the spinning action induced by the stationary vane means into an outer annulus of aqueous drilling liquid designated by the number 276 and an inner central core, primarily air, designated by the number 278. Combustible fluid is supplied in line 280 to burner 282, disposed downstream of the assembly in the air core. By igniting the burner, sufficient heat is produced to generate steam directly from the water free surface in the aqueous liquid annulus. This system also may be utilized in a conventional bore hole system.

Figure 42:
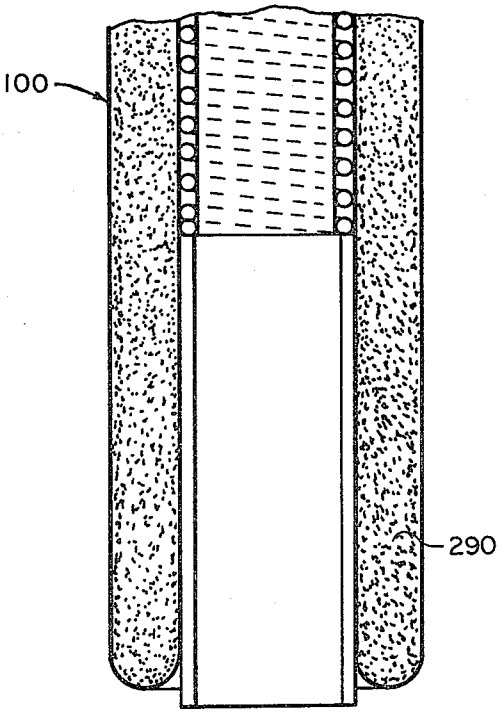
FIG. 42 is an enlarged, cross-sectional view of the forward end of the central pipe with a gravel pack contained within the eversible tube to form a casing.

Referring to FIG. 42, another embodiment of the present invention is illustrated, including a conventional gravel pack material 290, which is pumped into the interior of tube 100, forcing out the driving fluid after the bore hole is completed. Such gravel pack filters out sand so that it does not back fill into the cased well bore. In that regard, it is preferable to form the central pipe of a flexible steel helix with turns spaced approximately 0.015 to 0.030 in. apart to provide a support structure for the gravel pack and thereby form a production system in place.

Figure 43:
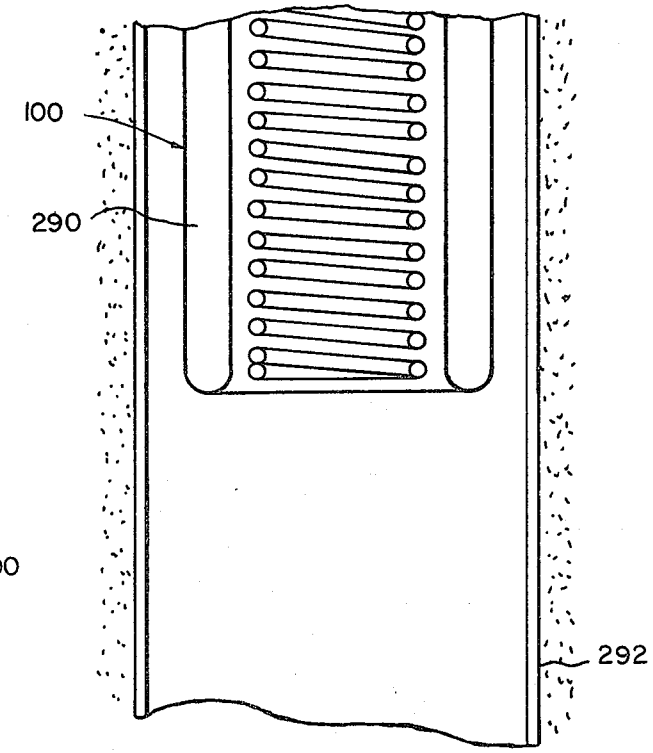
FIG. 43 illustrates the device of FIG. 42 contained within an external conventional casing for serving as an interior gravel pack device.

In another embodiment, illustrated in FIG. 43, the system of the present invention is passed downwardly into a conventional bore hole casing 292, e.g. formed of a slotted liner, and gravel pack 290 is filled into tube 100. This provides a convenient mode for gravel packing a conventional, cased bore hole.

Figure 44:
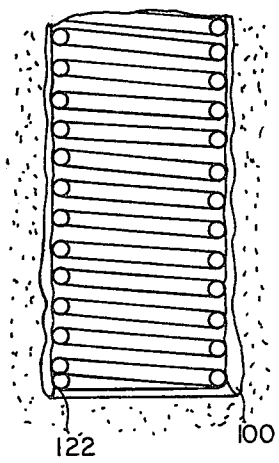
FIG. 44 is a view similar to FIG. 42 but showing the casing collapsed.

Referring to FIG. 44, a flexible, helical central pipe and eversible tube 100 according to the present invention are illustrated, tube 100 forming an ultimate casing for the central pipe with the tube being utilized as a bag filter substitute for gravel pack. After the completion of drilling, the surrounding formation would bear against the tube 100 to cause it to contract, as illustrated, against the central helical pipe 122 to form a suitable casing for production.

In another embodiment of the invention, the liquid permeability of a hollow, flexible, porous fabric tube, particularly useful for eversible tube 100, may be selectively varied by passing a slurry to the interior of the tube with solids of the slurry being of a size to plug the porous openings of the woven fabric to the desired predetermined extent.

A further disclosure of the nature of the present invention is illustrated by the following specific examples of its practice.

EXAMPLE 1

A laboratory scale model of the present invention is built as follows. It includes a central pipe with a rigid forward central pipe segment, formed of a hollow metal cylinder (0.75 in. O.D.×0.625 in. I.D. and 18 in. long). It is connected at its rearward end to a flexible polyethylene central pipe segment of the same diameters. The outer flexible double-layered eversible tube is formed about the central pipe segments and is of nylon cloth (Bally 8136, supplied by Bally Ribbon Co., Bally, PA.).

The expanded dimensions of the nylon tube are 1.9 in. O.D. A drill assembly of the type illustrated in FIGS. 1 and 5 is employed.

The device is placed horizontally into clear sand and water is flowed through the central pipe at an inlet flow rate of 24 gpm, 50–150 psig. Water is also flowed into the annulus of the flexible tube at 12–24 gpm, at 20–60 psig and a portion diffuses radially inwardly and outwardly through the eversible tube. The central pipe advances through the sand at 0.25 to 0.5 feet/second.

It is found that the slurry formed at the forward end flows back through the flow tube progressively formed in the sand along the outer wall of the eversible tube along the top surface thereof, while larger cuttings settle and deposit at the bottom of the eversible tube to provide support for the eversible tube. The top backward flow of slurry in the flow tube is assisted by the progressive leakage of driving fluid through the porous eversible tube.

EXAMPLE 2

A production scale model of the present invention is built as follows. It includes a central pipe with a rigid forward segment formed of a hollow metal cylinder (3.5 in. O.D.×3.0 in. I.D. and 1.5 to 3 ft. long). It is connected at its rearward end to a long steel helical spring segment lined externally with a flexible thin plastic or cloth sheath. The outer flexible double-layered eversible tube is formed of woven Kevlar cloth (or cloth with the weaker but more flexible nylon warp and the stronger but more rigid Kevlar fill). The cloth is coated with plastic (a polyurethane sold under the trademark Varathane, by Flecto Co., Inc. of Oakland, CA). It has about 56×44 yarns/in. Darts (0.125 in. wide) axially spaced apart about 4 to 8 in. extend through circumferentially extending arcs of from 30° to 180° to provide a turning radius for the eversible tube of about 20 feet. The device includes a drill assembly of the type illustrated in FIGS. 1 and 5 at the forward end of the central pipe.

The apparatus is first directed vertically into an oil sand deposit. Drilling fluid flows into the central pipe at about 550 gpm and an outlet nozzle flow velocity of 25 feet/second for an advance rate of 0.25 to 0.5 feet/-second. When the darts on the inner wall move past the rollover area to the outer wall, the central tube progressively turns from the vertical to the horizontal in the formation.

The drilling fluid is aqueous at a pH of 11.0 to 11.5 and a temperature of 180° to 250° F. It includes a monovalent cation (sodium) hydroxide at a concentration of 0.1 M (for fresh water) or 0.05 M for salt water. For salt water, 0.007 M to 0.05 M adjunct surfactant (trisodium phosphate) is added. Air is pumped with the fluid at a rate of about 5,000 to 10,000 S.T.P. barrels air/barrel of oil.

We claim:

1. The method of forming an underground bore hole using an apparatus comprising an elongate eversible rolling diaphragm with outer and inner walls interconnected at their forward end by a rollover area and being open at the other end, said outer wall being restrained, said inner wall defining to its interior a central passageway, an annular space for driving fluid being provided between said outer and inner walls, a hollow central pipe being provided in said central channel to extend proximal to said rollover area, said inner wall and central pipe defining therebetween a drilling fluid annulus, said method comprising the steps of (a) positioning the apparatus so that the rollover area projects into a proximal underground formation, (b) directing drilling fluid through said drilling fluid annulus and the central pipe to drill the formation to form cuttings of the formation and a slurry containing said cuttings at the proximal underground formation of increased susceptibility to penetration, (c) directing driving fluid through said driving fluid annular space to bear against said rollover area and to cause the inner wall adjacent said rollover area to progressively undergo a transformation in shape and become the outer wall to move the rollover area forwardly into the thus-formed slurry in the earth formation, and (d) carrying said central pipe forward in said central passageway as a function of the forward movement of said rollover area.

2. The method of claim 1 in which said slurry is directed exteriorly back along said rolling diaphragm.

3. The method of claim 1 in which said earth formation includes an oil- or mineral-bearing area and said bore hole extends a substantial distance into said area.

4. The method of claim 1 together with the step of substantially changing the direction of travel of said rolling diaphragm during its forward movement.

5. The method of claim 1 in which said central pipe includes a fluid permeable portion so that there is fluid communication between said drilling fluid annulus and central pipe interior.

6. The method of claim 1 in which said carrying step includes advancing the central pipe by frictional contact with the inner wall internal surface.

7. The method of claim 2 in which is included the step of advancing said central pipe into said central passageway from a point rearwardly of said outer wall restraint.

8. The method of claim 1 in which said central pipe includes a flexible turning segment, together with the step of bending said turning segment to cause said central pipe to alter its path and to be engaged by said rolling diaphragm to move in a predetermined change of direction.

9. The method of claim 8 in which said bending is caused by flowing drilling fluid through an open port in said central pipe.

10. The method of claim 8 in which said bending is caused by heating and thereby expanding a selected partial circumferential segment of said central pipe.

11. The method of claim 8 in which said bending is caused by applying fluid forces to a selected partial circumferential segment of said central pipe.

12. The method of claim 8 in which said central pipe includes heat deformable strips in a selected partial circumferential segment and said bending is caused by heating said strips.

13. The method of claim 1 in which said rolling diaphragm is formed of liquid permeable fabric which leaks liquid out of the outer wall to assist in fluidizing said slurry.

14. The method of claim 1 in which said apparatus includes a moveable nozzle forwardly of said central pipe and together with the steps of flowing drilling fluid through the central pipe interior and moving said nozzle in a predetermined direction to redirect the drilling fluid and path of slurrying action and thus redirect the path of said rolling diaphragm.

15. The method of claim 1 in which the apparatus includes at least one movable fin forward of said central pipe in the path of drilling flid flow, together with the step of moving said fin to redirect the drilling fluid and path of slurrying action and thus redirect the path of said rolling diaphragm.

16. The method of claim 1 together with the step of tracking said apparatus path by generating a signal at the forward end of said central pipe and receiving said signal at multiple remote stations.

17. The method of claim 1 in which said formation is oil-bearing with said oil in an essentially continuous phase in contact with water in a discontinuous phase and in which said drilling fluid is aqueous and converts said oil into a discontinuous phase dispersed in a continuous aqueous phase.

18. The method of claim 17 in which said drilling fluid comprises an aqueous solution formed (a) of monovalent alkali metal hydroxide at a pH of at least about 8.5 or (b) of a monovalent strong acid at a pH no greater than 5.5 and at an elevated temperature at contact with said proximal underground formation.

19. The method of claim 18 in which said alkali metal or strong acid reacts with constituents of the oil to form a surfactant in situ which causes the formation of an emulsion to assist in breaking up the matrix of the in situ formation and in forming the slurry.

20. The method of claim 17 in which air in fine bubble form is pumped into the drilling fluid to provide an increased air-oil surface area interface to assist in the agglomeration of oil in the slurry and thus the separation of the oil from the water, said air also serving as a multi-stage air lift pump.

21. The method of claim 17 in which said drilling fluid includes a surfactant and said drilling fluid and oil in said formation from a micro-emulsion phase of oil and water dispersed in the submicron size range with essentially no interfacial tension therebetween.

22. The method of claim 21 in which said surfactant is a sulfonate.

23. The method of claim 21 in which said drilling fluid is salt water-based and includes a water softener.

24. The method of claim 1 in which said drilling fluid includes oil.

25. The method of claim 1 in which said earth formation includes an underground geothermal steam region, and said bore hole extends a substantial distance into said region.

26. The method of claim 1 in which said eversible tube is moved to form a continuous conduit from the earth formation surface into said geothermal steam region and back to the earth formation surface and wherein, a heat transfer fluid is pumped through said conduit into and out of said earth formation so that it is heated by the surrounding geothermal steam.

27. The method of claim 1 in which said drilling fluid is aqueous and said formation is an oil-bearing formation, with oil in an essentially continuous phase in contact with water in a discontinuous phase, the additional step of forming a slurry in which said oil is converted into a discontinuous phase dispersed in a continuous aqueous phase.

28. The method of claim 27 in which the slurry is pumped back to the surface through the conduit to excavate the forward end of the bore hole.

29. The method of claim 27 in which the the drilling fluid comprises an aqueous monovalent alkali metal hydroxide or silicate solution at a pH of at least 8.5 or strong acid at a pH less than 5.5 and at an elevated temperature at contact with said proximal underground formation.

30. The method of claim 27 in which a surfactant is included in the drilling fluid and a micro-emulsion is formed between the aqueous drilling fluid and oil in the formation.

31. The method of claim 30 in which said surfactant is an oil sulfonate.

32. The method of forming an underground bore hole using a rolling diaphragm comprising an outer wall restrained at its rearward end, an inner wall and a connecting rollover area at the forward end thereof, the inner wall defining to its interior a continuous central passageway, said method comprising the steps of (a) passing drilling fluid through said central passageway to drill the formation and form a slurry with the cuttings from the formation near to said rollover area, (b) directing the thus formed slurry exteriorly of and along said outer wall to evacuate the underground formation adjacent the rollover area, and (c) moving the rollover area forwardly by advancing the inner wall to cause it to progressively transform in shape into the outer wall across the rollover area.

33. The method of forming an underground cased bore hole comprising the steps of (a) excavating the bore hole in an underground formation, (b) inserting a casing into the bore hole comprising a hollow pipe formed of a helical spring-like winding which is liquid permeable between the turns of the winding, (c) inserting a flexible two walled tubular sheath with a spacing between the walls into the bore hole together with the casing to surround the casing, and (d) filling the spacing between the walls with particulate packing capable of filtering solids of a predetermined size.

34. The method of claim 33 together with the step of surrounding the helical casing with a liquid permeable particulate packing capable of filtering solids of a predetermined size.

35. The method of forming an underground cased bore hole comprising the steps of excavating the bore hole in an underground formation, inserting a hollow helical casing together with a flexible two walled tubular sheath surrounding such casing into said bore hole, and filling the spacing with the packing between said two walls.

36. The method of claim 33 in which said tubular sheath comprises a liquid permeable fabric.

37. The method of forming an underground cased bore hole comprising the steps of (a) excavating the bore hole in an underground formation, (b) inserting a casing into the bore hole comprising a hollow helix, and (c) inserting a liquid permeable tubular sheath fabric surrounding the casing into said bore hole together with said casing to form a bag filter capable of filtering solids of a predetermined size.

38. A method of drilling a bore hole in an underground formation comprising: directing a drilling fluid continuously through and out of a movable pipe and against the formation to drill the formation to form cuttings of the formation, whereby a mixture of the drilling fluid and the cuttings of the formation define a slurry; moving the pipe progressively in one direction as the formation is drilled; and keeping the pipe out of substantial frictional engagement with the formation as the pipe moves in said one direction, said keeping step comprising forming said pipe of a liquid permeable material and flowing liquid from the interior to the exterior of said pipe along its length to fluidize the adjacent formation to a sufficient extent to lubricate the space between said pipe and formation.

39. A method of drilling a bore hole in an underground formation comprising: directing a drilling fluid continuously through and out of a movable pipe and against the formation to drill the formation to form cuttings of the formation, whereby a mixture of the drilling fluid and the cuttings of the formation define a slurry; moving the pipe progressively in one direction as the formation is drilled; and keeping the pipe out of substantial frictional engagement with the formation as the pipe moves in said one direction, said keeping step including forming a stationary boundary adjacent to the portion of the formation surrounding at least a part of the pipe with the boundary being spaced from the outer surface of the pipe, and directing a fluid into the space between the boundary and the pipe to allow the pipe to move relative to the boundary without contacting the boundary.

40. A method as set forth in claim 39, wherein the boundary increases in length as the pipe moves in said one direction.

41. A method as set forth in claim 39, wherein the pipe has a fluid outlet, said boundary having an end which is adjacent to the outlet of the pipe for all positions of the outlet with respect to the formation.

42. A method as set forth in claim 39, wherein the allowing step includes permitting the slurry to pass between the boundary and the formation in the opposite direction.

* * * * *